US007742725B2

(12) United States Patent
Mase et al.

(10) Patent No.: US 7,742,725 B2
(45) Date of Patent: Jun. 22, 2010

(54) DEVELOPING DEVICE

(75) Inventors: Soichiro Mase, Handa (JP); Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 346 days.

(21) Appl. No.: 12/022,205

(22) Filed: Jan. 30, 2008

(65) Prior Publication Data

US 2008/0181660 A1 Jul. 31, 2008

(30) Foreign Application Priority Data

Jan. 30, 2007 (JP) ..... 2007-019866
Jan. 30, 2007 (JP) ..... 2007-019868

(51) Int. Cl.
*G03G 15/08* (2006.01)

(52) U.S. Cl. ..... 399/258; 399/262

(58) Field of Classification Search ..... 399/258, 399/260, 262, 119
See application file for complete search history.

(56) References Cited

U.S. PATENT DOCUMENTS 5,266,998 A * 11/1993 Lee ..... 399/119
5,608,501 A 3/1997 Makino
2008/0013988 A1* 1/2008 Murakami et al. ..... 399/258

FOREIGN PATENT DOCUMENTS

JP 07-225514 8/1995

* cited by examiner

*Primary Examiner*—Susan S Lee
(74) *Attorney, Agent, or Firm*—Banner & Witcoff, Ltd.

(57) ABSTRACT

A developing device includes a developer carrier, a developing case and a toner cartridge. The toner cartridge includes a toner case including a first opening and a first blocking member. The developing case includes a second opening, a second blocking member and an opening/closing member. The opening/closing member is swingable among a first position where the toner cartridge is detached from the developing case and the second opening is closed, a second position where the toner cartridge is attached to the developing case and the first opening and the second opening are communicate with each other, and a third position between the first position and the second position where the toner cartridge is attached to the developing case and the first opening and the second opening are closed. The opening/closing member swings from the first position to the third position when the toner cartridge is attached to the developing case.

19 Claims, 13 Drawing Sheets

UPPER SIDE
FRONT SIDE
REAR SIDE
LOWER SIDE

DEVELOPING DEVICE

CROSS-REFERENCE TO RELATED APPLICATIONS

This application claims priority from Japanese Patent Applications No. 2007-019866 filed on Jan. 30, 2007 and No. 2007-019868 filed on Jan. 30, 2007, the entire subject matter of which is incorporated herein by reference.

TECHNICAL FIELD

Aspects of the present invention relate to a developing device including a detachable toner cartridge for an image forming apparatus such as a laser printer.

BACKGROUND

There has been proposed a developing device of a laser printer in which a toner cartridge is detachably attached to a developing case, and opening/closing operations of a first blocking member that closes a first opening of the toner cartridge are interlocked with those of a second blocking member that closes a second opening of the developing case in order to prevent a toner from unnecessarily leaking.

JP-A-7-225514 discloses a developing device in which a case has a pair of right and left blankets, a second shutter is attached to an arm which is swingably disposed on boss portions of outer peripheries of support grooves of the blankets, and a first shutter is disposed on a lever which is swung about a support shaft of the toner cartridge. The support shaft of the toner cartridge is fitted into support grooves of the developing case. When the lever of the toner cartridge is swung in this state, an engaging projection disposed on the lever of the toner cartridge swings the arm of the developing case, thereby openingly/closingly swing the first shutter and the second shutter in an overlapping state.

In such a configuration, when the lever is accidentally swung in a state where the toner cartridge is detached from the developing case, the first shutter is swung to open a toner discharging port, thereby causing the possibility that a toner in the toner cartridge may leak. Also in the developing case which is in a state where the toner cartridge is detached, when the arm is accidentally swung, the second shutter is swung to open a toner introducing port. Thus, a toner may be leaked from a stirring chamber.

Thus, in the toner cartridge disclosed by JP-A-7-225514, when the toner cartridge is detached from the developing device, the first shutter is maintained to close the toner discharging port by a first locking mechanism. In the developing device, the second shutter is maintained to close the toner introducing port by a second locking mechanism. Therefore, if the toner cartridge is detached from the developing device, the first locking mechanism and the second locking mechanism prevent the first shutter and the second shutter from being accidentally swung to cause the toner to leak from the interior of the toner cartridge and the stirring chamber of the developing device.

However, each of the first locking mechanism and the second locking mechanism disclosed in JP-A-7-225514 is configured by a locking member and a screw. Further, the first locking mechanism and the second locking mechanism are configured separately from the first or second shutter. In order to respectively attach the locking mechanisms to the first shutter and the second shutter, a push pin and an engaging hole must be formed in each of the first shutter and the second shutter. Thus, structure of the toner cartridge and the developing case may be complicated.

SUMMARY

Aspects of the invention provide a developing device which can enhance degree of freedom in design and prevent developer from leaking by a simple structure and an easy operation.

BRIEF DESCRIPTION OF THE DRAWINGS

FIGS. 11A to 11D are schematic views of the process cartridge showing manners of attaching and detaching the toner cartridge, in which FIG. 11A shows a manner in which the toner cartridge is detached, and the opening/closing lever is at the first position, FIG. 11B shows a manner in which the toner cartridge is shifted from the attachment position in the detaching direction, and the opening/closing lever is at the first position, FIG. 11C shows a manner in which the toner cartridge is at the attachment position, and the opening/closing lever is at the third position, and FIG. 11D shows a manner in which the toner cartridge is at the attachment position, and the opening/closing lever is at a second position.

DETAILED DESCRIPTION

<General Overview>

Figure 1:
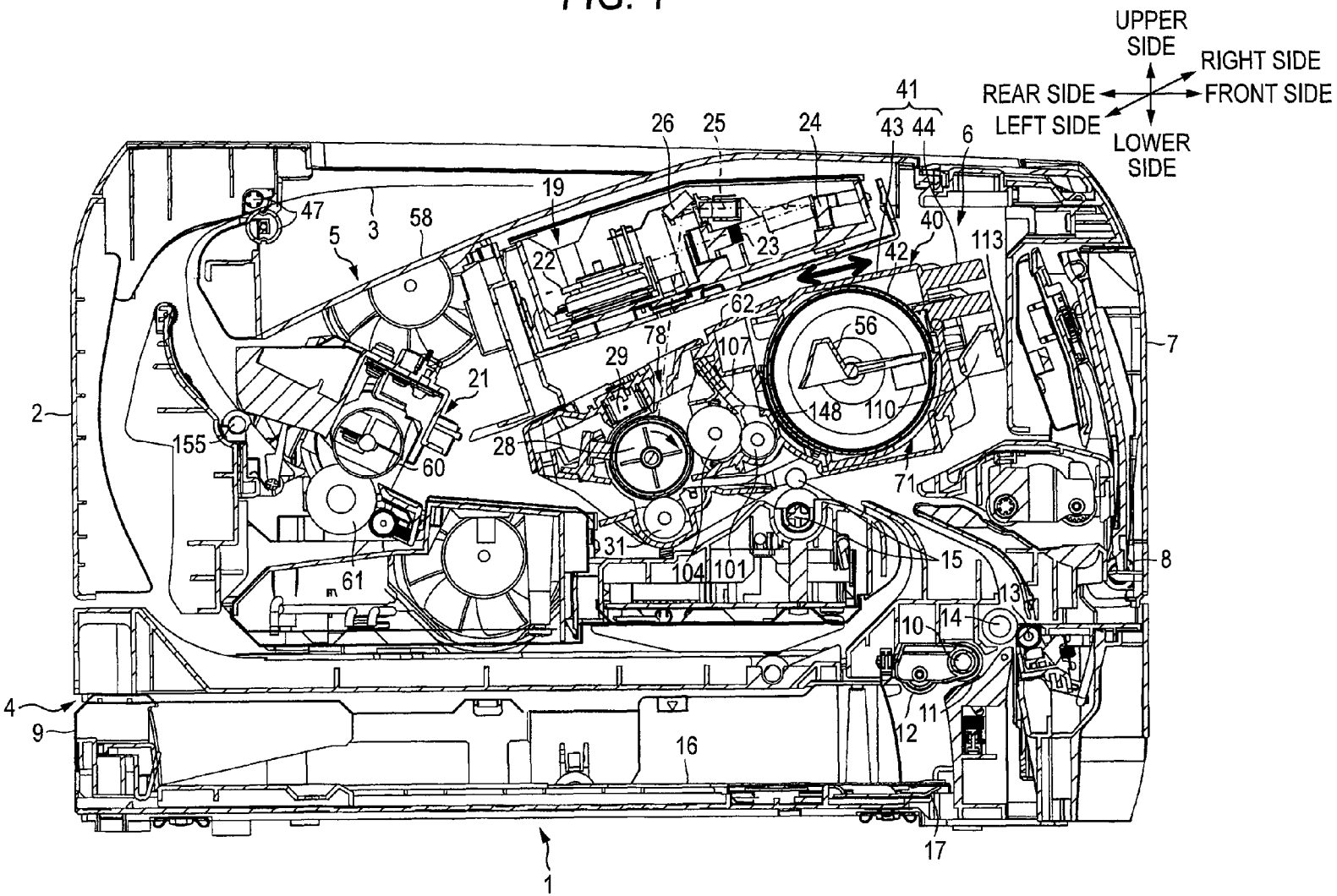
FIG. 1 is an exemplary side sectional view of a laser printer which is an example of the image forming apparatus.

According to an aspect of the invention, there is provided a developing device including: a developer carrier that carries developer; a developing case that supports the developer carrier; and a toner cartridge that houses the developer and is attachable to and detachable from the developing case, wherein the toner cartridge includes: a toner case including a first opening for supplying the developer to the developing case; and a first blocking member that opens and closes the first opening, wherein the developing case includes: a second opening for receiving the developer supplied from the first opening; a second blocking member that opens and closes the second opening; and an opening/closing member that is swingably disposed on the developing case and opens and closes the first blocking member and the second blocking member, wherein the opening/closing member is swingable among predetermined positions, the predetermined positions including: a first position where the toner cartridge is detached from the developing case and the second opening is closed; a second position where the toner cartridge is attached to the developing case and the first opening and the second opening are opened to communicate with each other; and a third position where the toner cartridge is attached to the developing case and the first opening and the second opening are closed to block communication between the first opening and the second opening, the third position being between the first position and the second position, and wherein the opening/closing member swings from the first position to the third position in accordance with attachment of the toner cartridge to the developing case.

According to another aspect of the invention, there is provided a developing device including: a developer carrier that carries developer; a developing case that supports the developer carrier; and a toner cartridge that houses the developer and is attachable to and detachable from the developing case, wherein the toner cartridge includes: a toner case including a first opening for supplying the developer to the developing case; and a first blocking member that opens and closes the first opening, wherein the developing case includes: a second opening for receiving the developer supplied from the first opening; a second blocking member that opens and closes the second opening; and an opening/closing member that is swingably disposed on the developing case and opens and closes the first blocking member and the second blocking member, wherein the opening/closing member is swingable among predetermined positions, the predetermined positions including: a first position where the toner cartridge is detached from the developing case and the second opening is closed; a second position where the toner cartridge is attached to the developing case and the first opening and the second opening are opened to communicate with each other; and a third position where the toner cartridge is attached to the developing case and the first opening and the second opening are closed to block communication between the first opening and the second opening, the third position being between the first position and the second position, and wherein the opening/closing member moves the toner cartridge from an attaching position to the developing case in a detaching direction of the toner cartridge in accordance with swinging of the opening/closing member from the first position to the third position.

<Illustrative Aspects>

Illustrative aspects of the invention will be described with reference to the drawings.

(Laser Printer)

FIG. 1 is an exemplary side sectional view showing a laser printer which is an example of the image forming apparatus of the invention.

As shown in FIG. 1, the laser printer 1 includes a body casing 2, a feeder portion 4 which feeds a sheet 3 housed in the body casing 2 and an image forming unit 5 which forms an image on the fed sheet 3. The body casing 2 is an example of the body of the image forming apparatus.

(1) Body Casing

In one side wall of the body casing 2, an access port 6 is formed through which a process cartridge 20 is passed during operations of attaching and detaching the process cartridge 20. A front cover 7 which openably covers the access port 6 is disposed. The process cartridge 20 is an example of a developing device (described later).

In the following description, the side where the front cover 7 is disposed in a state where the process cartridge 20 is attached to the body casing 2 is referred to as the front side (front face side), and the opposite side is referred to as the rear side (back face side). The front side in a thickness direction of the paper sheet of FIG. 1 is referred to as the left side, and the back side in the thickness direction of the paper sheet of FIG. 1 is referred to as the right side. The right and left direction may be referred to as a width direction.

The front cover 7 is swingably supported by a cover shaft 8, which is disposed in a lower end portion of the front cover 7. When the front cover 7 is closed with setting the cover shaft 8 as a fulcrum, the access port 6 is covered by the front cover 7. When the front cover 7 is opened with setting the cover shaft 8 as a fulcrum, the access port 6 is opened. Accordingly, the process cartridge 20 can be attached to and detached from the body casing 2 through the access port 6.

(2) Feeder Portion

The feeder portion 4 is disposed in a bottom portion of the body casing 2. The feeder portion 4 includes a sheet feed tray 9, a separating roller 10, a separation pad 11, a sheet feed roller 12, a paper dust removing roller 13, a pinch roller 14 and a registering roller 15.

The sheet feed tray 9 includes a sheet press plate 16 therein and a lever 17 in a front portion thereof. A front portion of the sheet press plate 16 is raised by the lever 17.

Sheets 3 stacked on the sheet press plate 16 is conveyed to a separation position between the separating roller 10 and the separation pad 11 by rotation of the sheet feed roller 12, separated one by one at the separation position, and passed between the paper dust removing roller 13 and the pinch roller 14 to be conveyed toward the registering roller 15.

The sheet 3 conveyed to the registering roller 15 is further conveyed to a transferring position between a photosensitive drum 28, which is an example of a photosensitive member (described later), and a transfer roller 31.

(3) Image Forming Unit

The image forming unit 5 includes a scanner portion 19, a process cartridge 20 and a fixing portion 21.

(a) Scanner Portion

The scanner portion 19 is disposed in an upper portion of the body casing 2. The scanner portion 19 includes a laser light source (not shown), a polygon mirror 22 that is rotatingly driven, an fθ lens 23, a reflecting mirror 24, a lens 25 and a reflecting mirror 26. As indicated by a chain line, a laser beam which is emitted from the laser light source on the basis of image data is deflected by the polygon mirror 22, and passed through the fθ lens 23, and the optical path is folded back by the reflecting mirror 24. The laser beam is passed through the lens 25, and the optical path is further downward folded back by the reflecting mirror 26, whereby the laser beam irradiates the surface of the photosensitive drum 28 of the process cartridge 20.

(b) Process Cartridge

Figure 2:
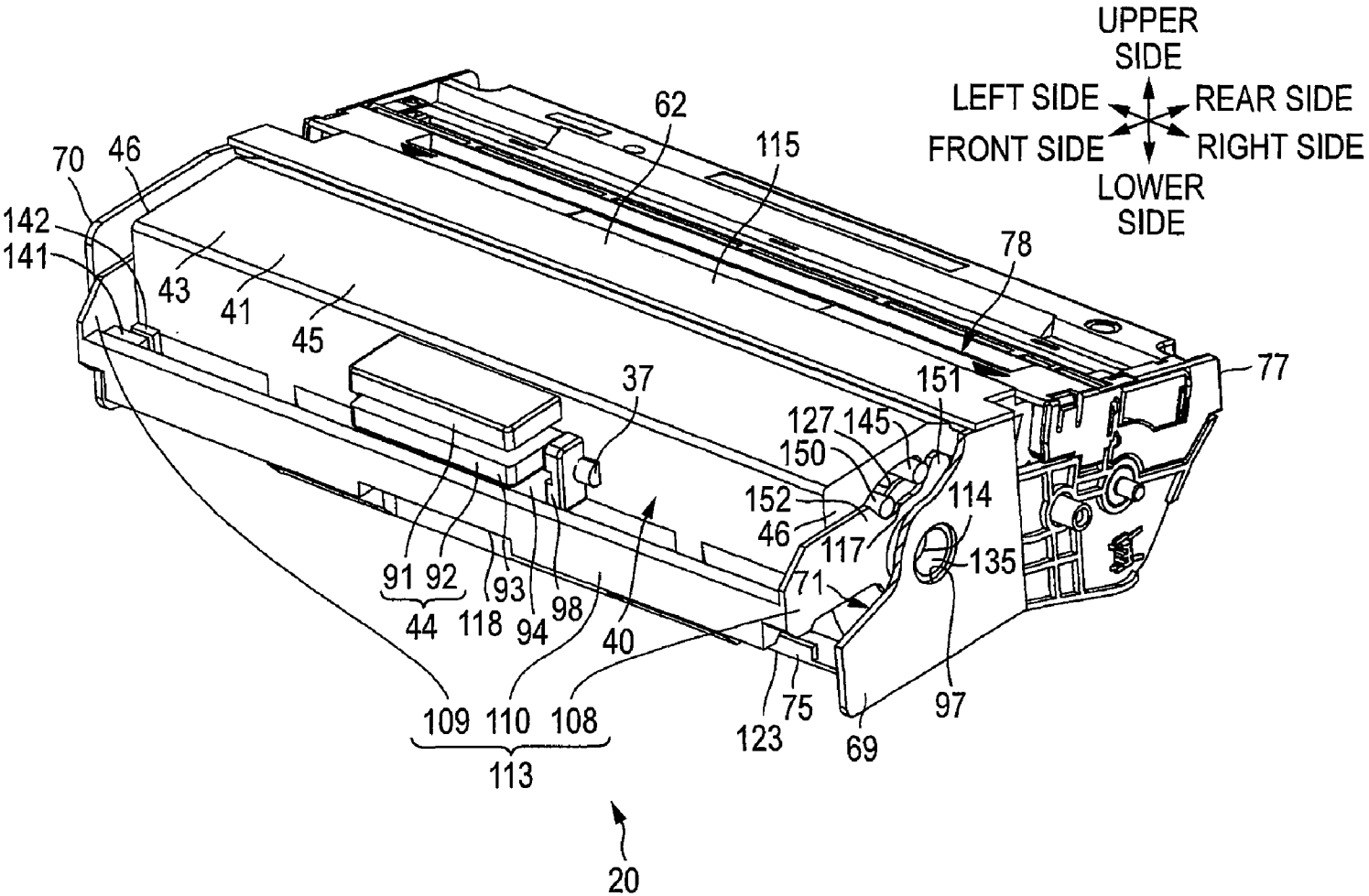
FIG. 2 is an exemplary right side perspective view of a process cartridge in the laser printer shown in FIG. 1, as viewed from a front upper side.
Figure 3:
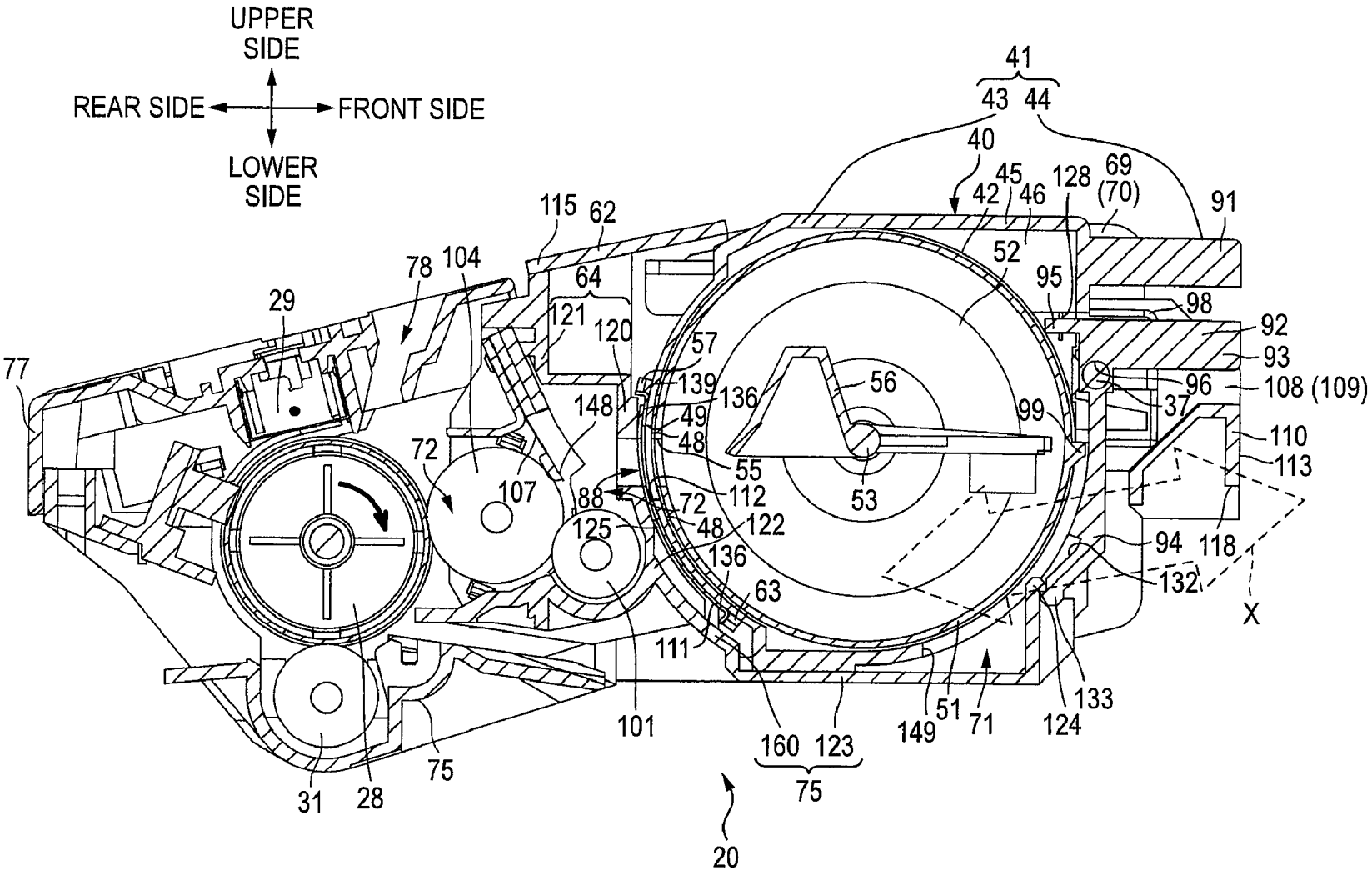
FIG. 3 is an exemplary left side sectional view of the process cartridge of FIG. 2.

FIG. 2 is an exemplary right side perspective view of the process cartridge in the laser printer shown in FIG. 1, as viewed from the front upper side. FIG. 3 is an exemplary left side sectional view of the process cartridge of FIG. 2.

Figure 4A:
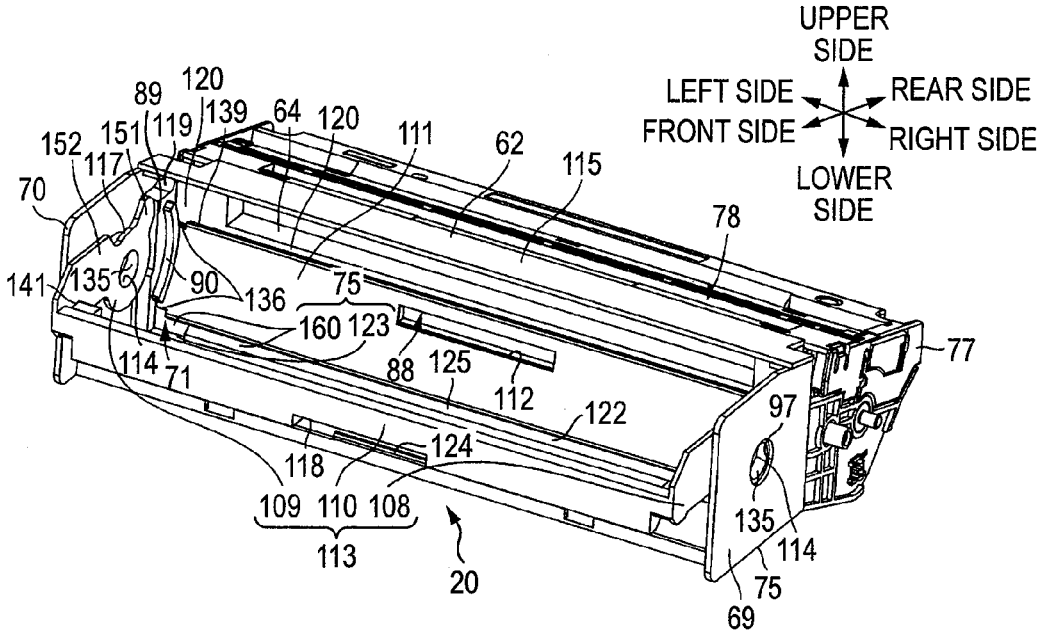
FIG. 4A is a schematic view of the process cartridge showing a state where an opening/closing lever is at an abutting position in FIG. 2.
Figure 4B:
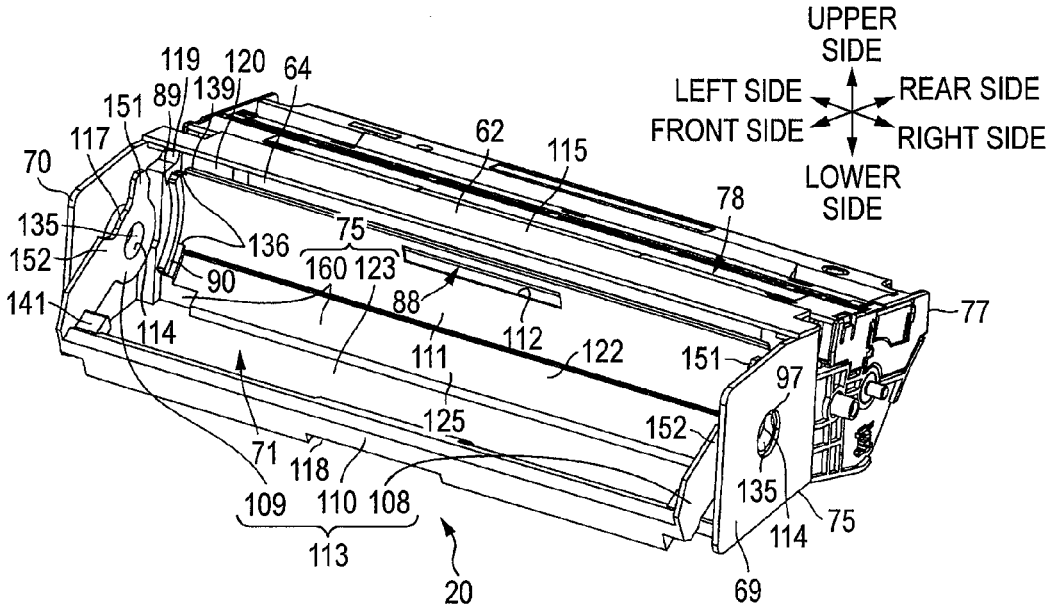
FIG. 4B is a schematic view showing a state where the opening/closing lever is at a canceling position in FIG. 4A.
Figure 4C:
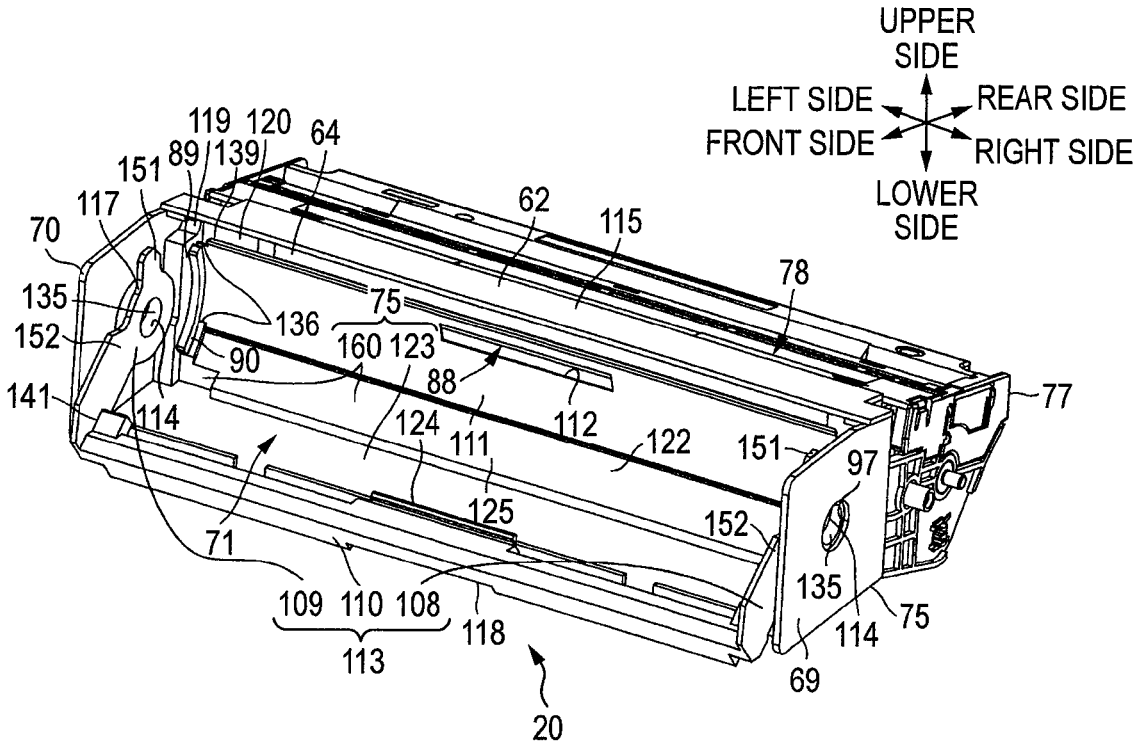
FIG. 4C is a schematic view showing a state where the opening/closing lever is at a detaching position in FIG. 4A.

FIG. 4A is a schematic view of the process cartridge showing a state where a toner cartridge is removed away from the process cartridge in FIG. 2, and an opening/closing lever is at an abutting position to open a toner introduction port. FIG. 4B is a schematic view showing a state where the opening/closing lever is at a canceling position to close the toner introduction port in FIG. 4A. FIG. 4C is a view showing a state where, in FIG. 4A, the opening/closing lever is at a detaching position to close the toner introduction port.

Figure 5A:
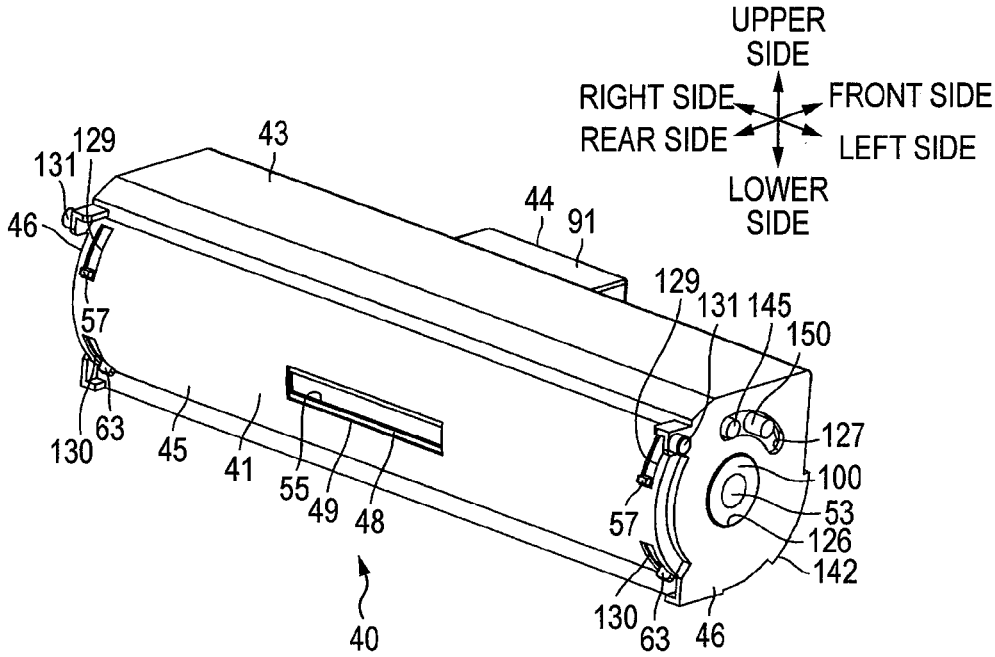
FIG. 5A is an exemplary left side perspective view of the toner cartridge of the process cartridge as viewed from a rear upper side, and showing a state where a toner discharging port is opened.
Figure 5B:
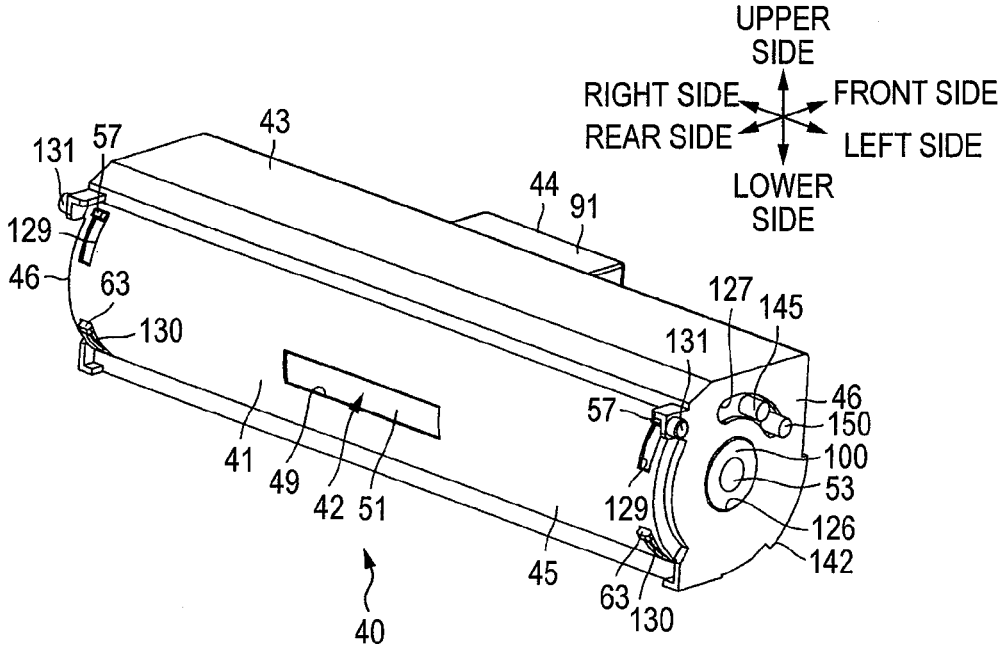
FIG. 5B is an exemplary left side perspective view showing a state where the toner discharging port is closed in FIG. 5A.
Figure 5C:
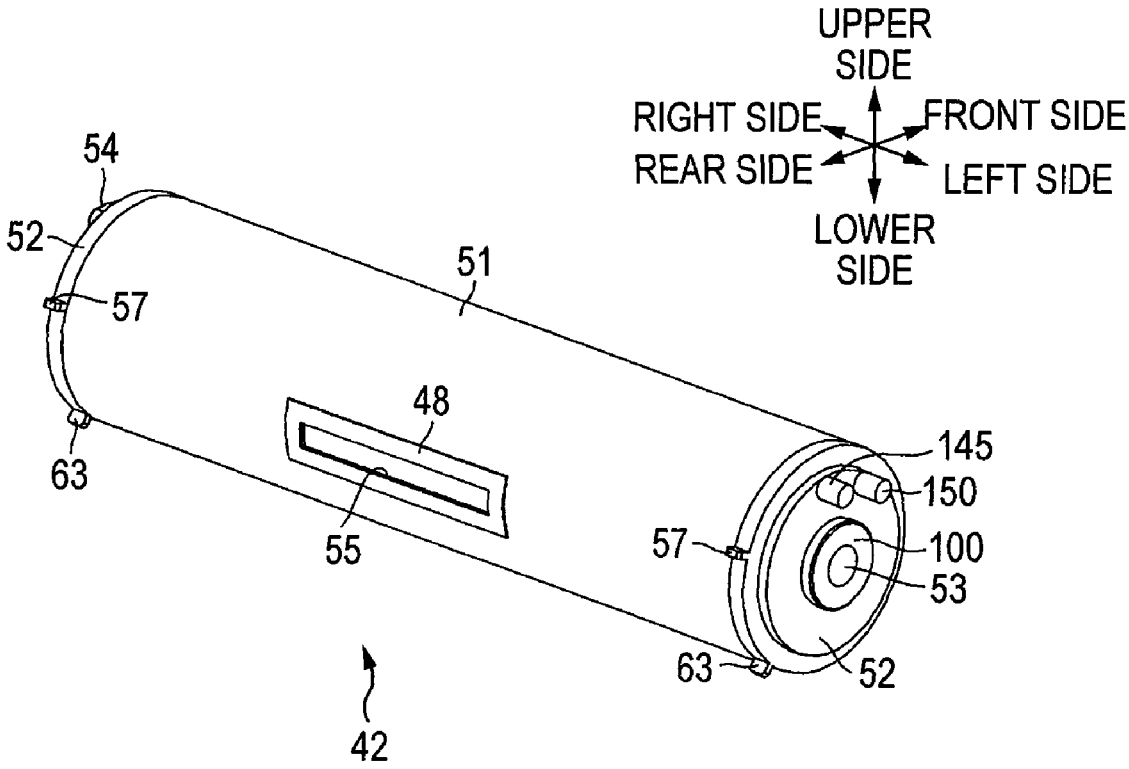
FIG. 5C is an exemplary left side perspective view of an inner case of the toner cartridge shown in FIG. 5A as viewed from the rear upper side.

FIG. 5A is an exemplary left side perspective view of the toner cartridge of the process cartridge shown in FIG. 2, as viewed from the rear upper side, and showing a state where a toner discharging port is opened. FIG. 5B is an exemplary left side perspective view showing a state where, in FIG. 5A, the toner discharging port is closed. FIG. 5C is an exemplary left side perspective view of an inner case of the toner cartridge shown in FIG. 5A, as viewed from the rear upper side.

Figure 6:
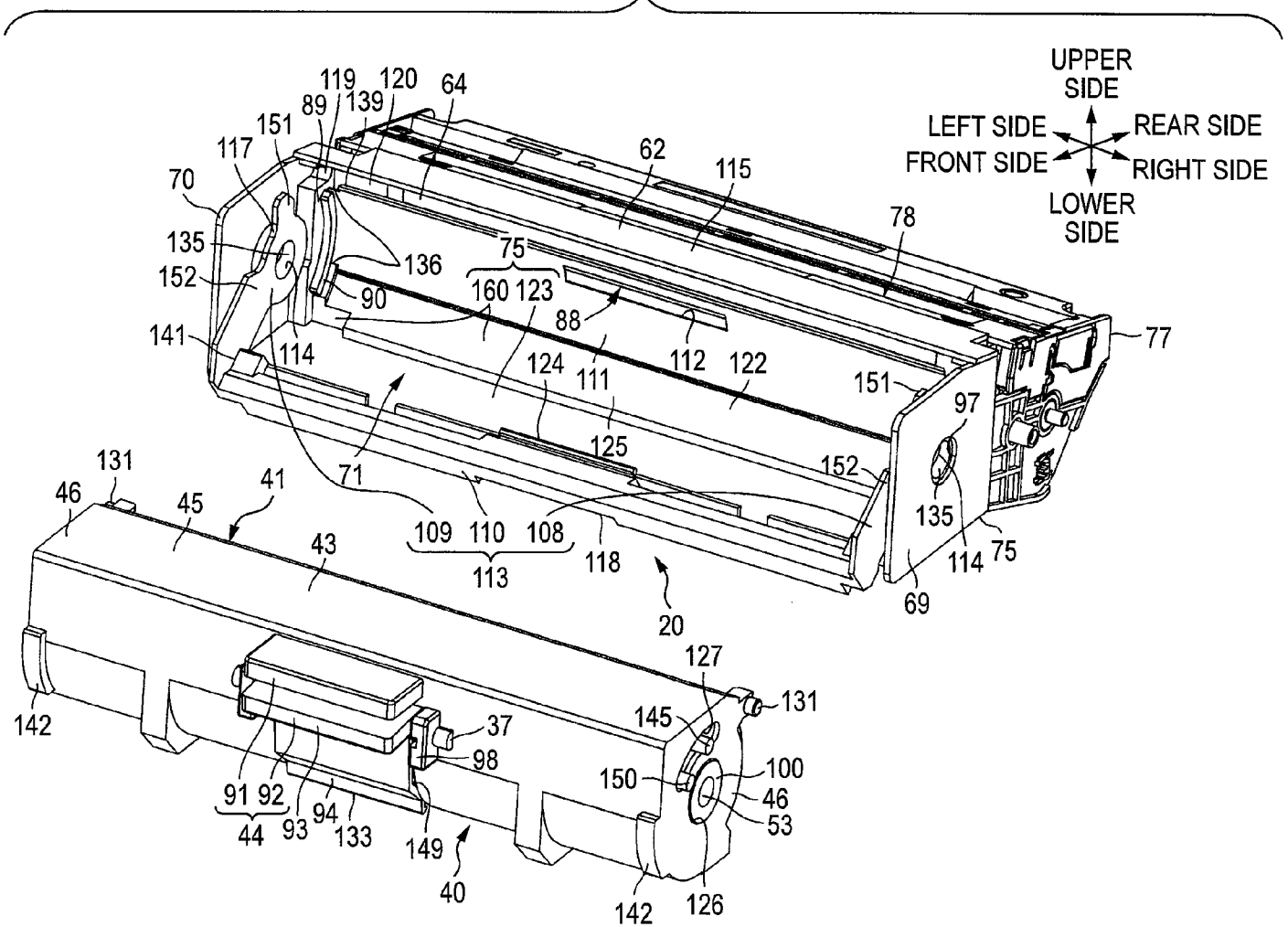
FIG. 6 is an exemplary view showing a state where the toner cartridge is detached and the opening/closing lever is at a first position in FIG. 2, together with the detached toner cartridge.
Figure 7:
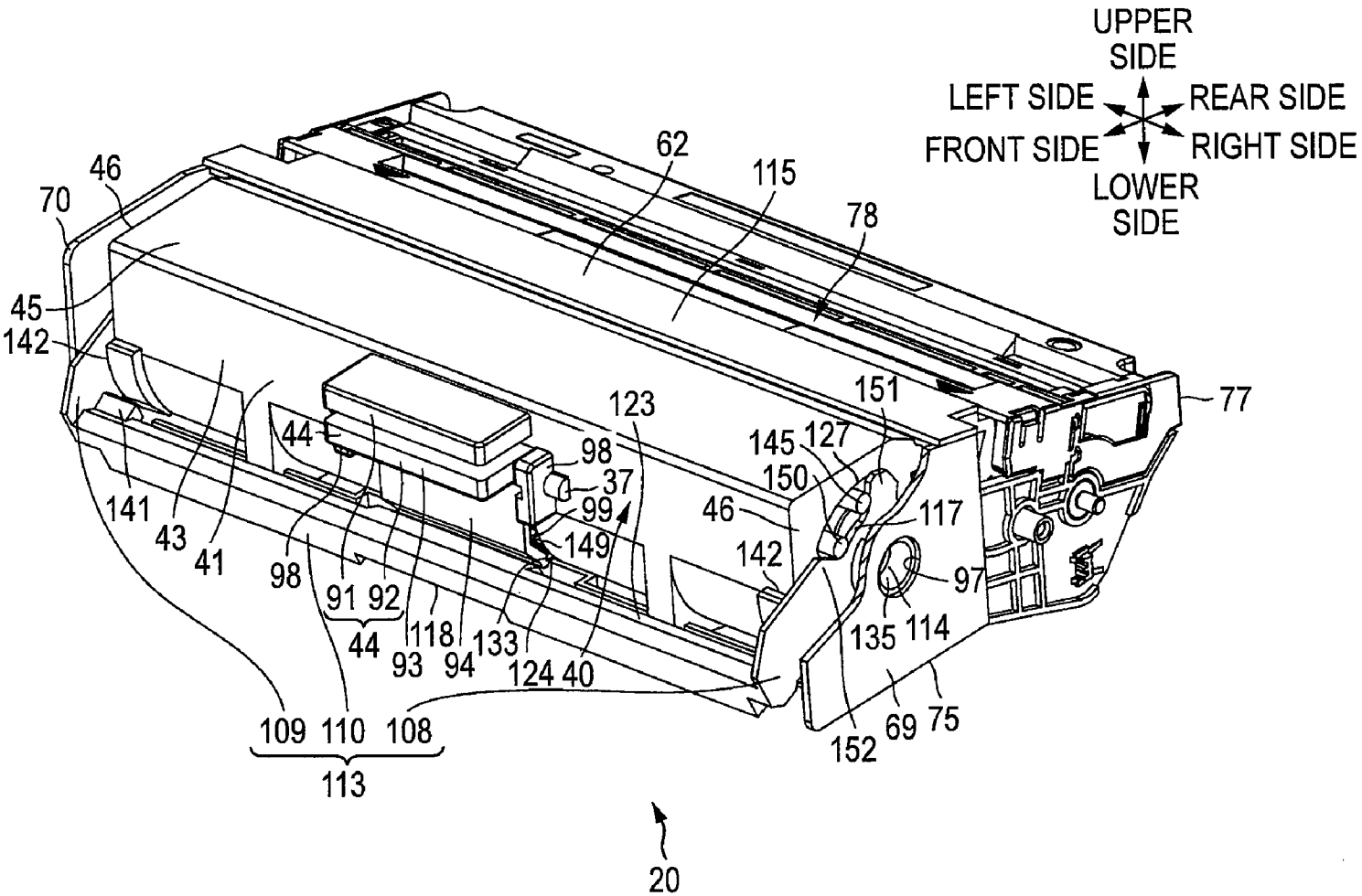
FIG. 7 is an exemplary view showing a state where the opening/closing lever is at a third position in FIG. 2.

FIG. 6 shows a state where the toner cartridge is detached and the opening/closing lever is at the canceling position in FIG. 2, together with the detached toner cartridge. FIG. 7 shows a state where the opening/closing lever is at the canceling position in FIG. 2.

Figure 8:
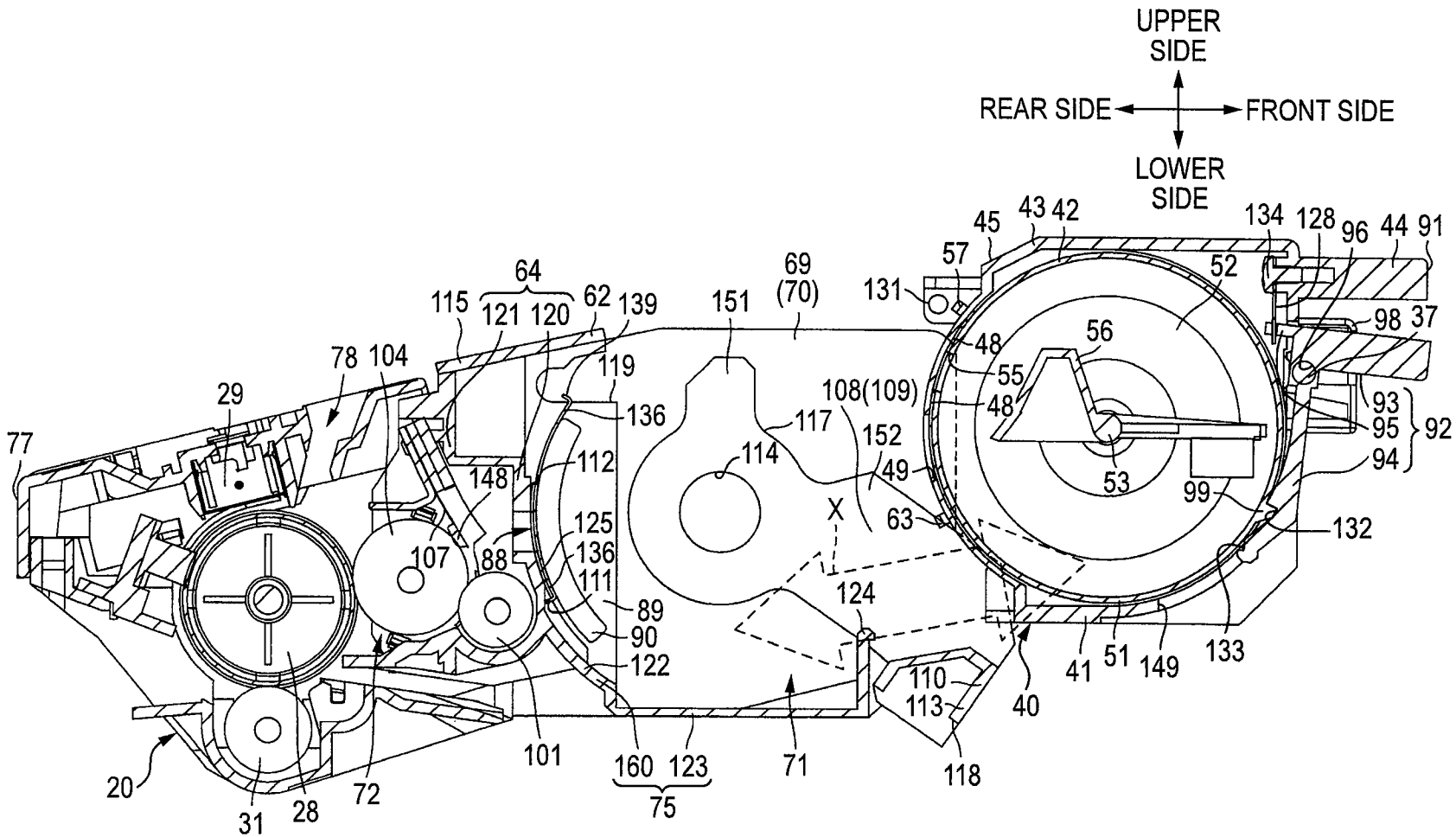
FIG. 8 is an exemplary left side sectional view of the process cartridge of FIG. 6.
Figure 9:
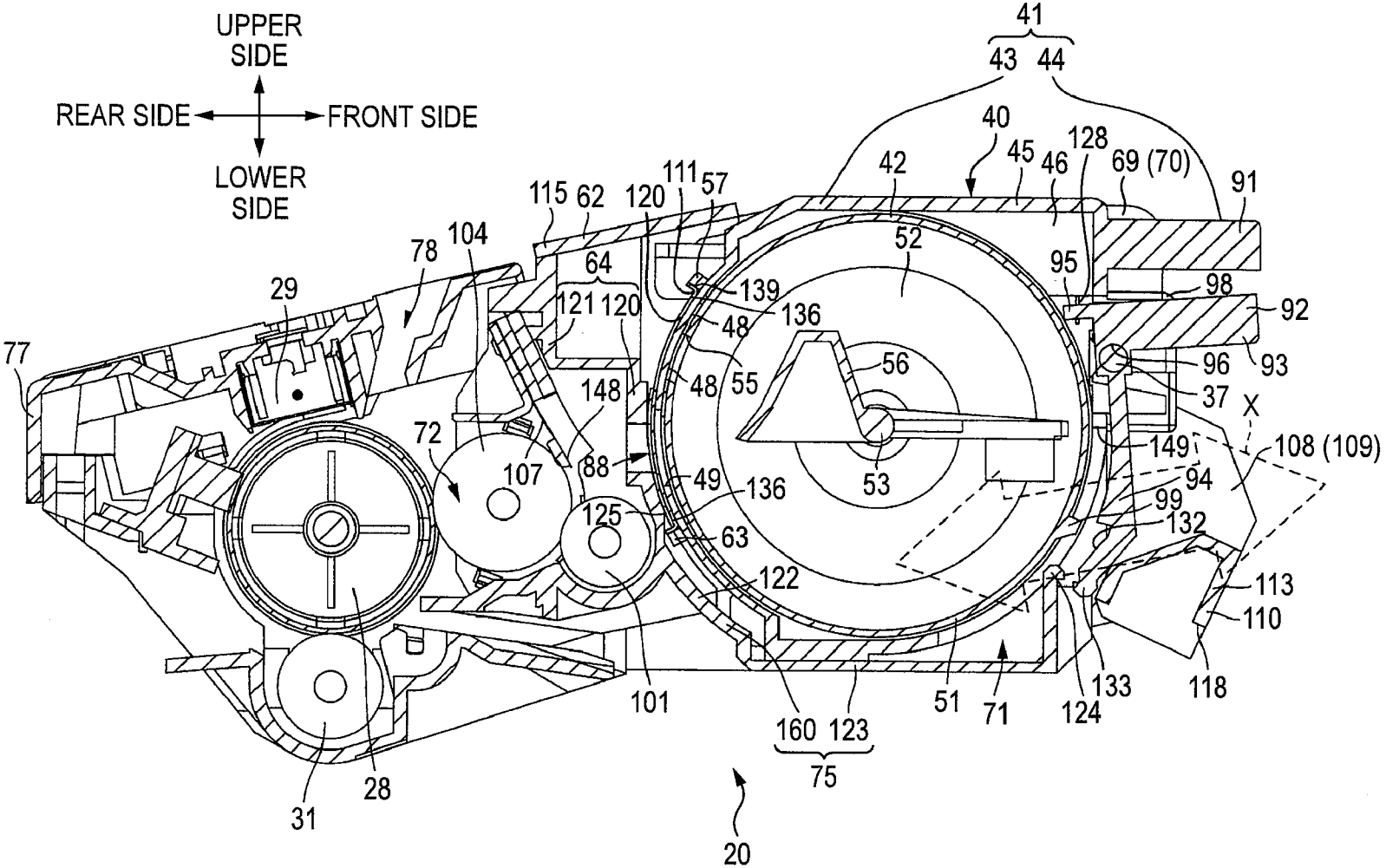
FIG. 9 is an exemplary left side sectional view of the process cartridge of FIG. 7 and showing a state where a state where a swinging portion is in a second state.
Figure 10:
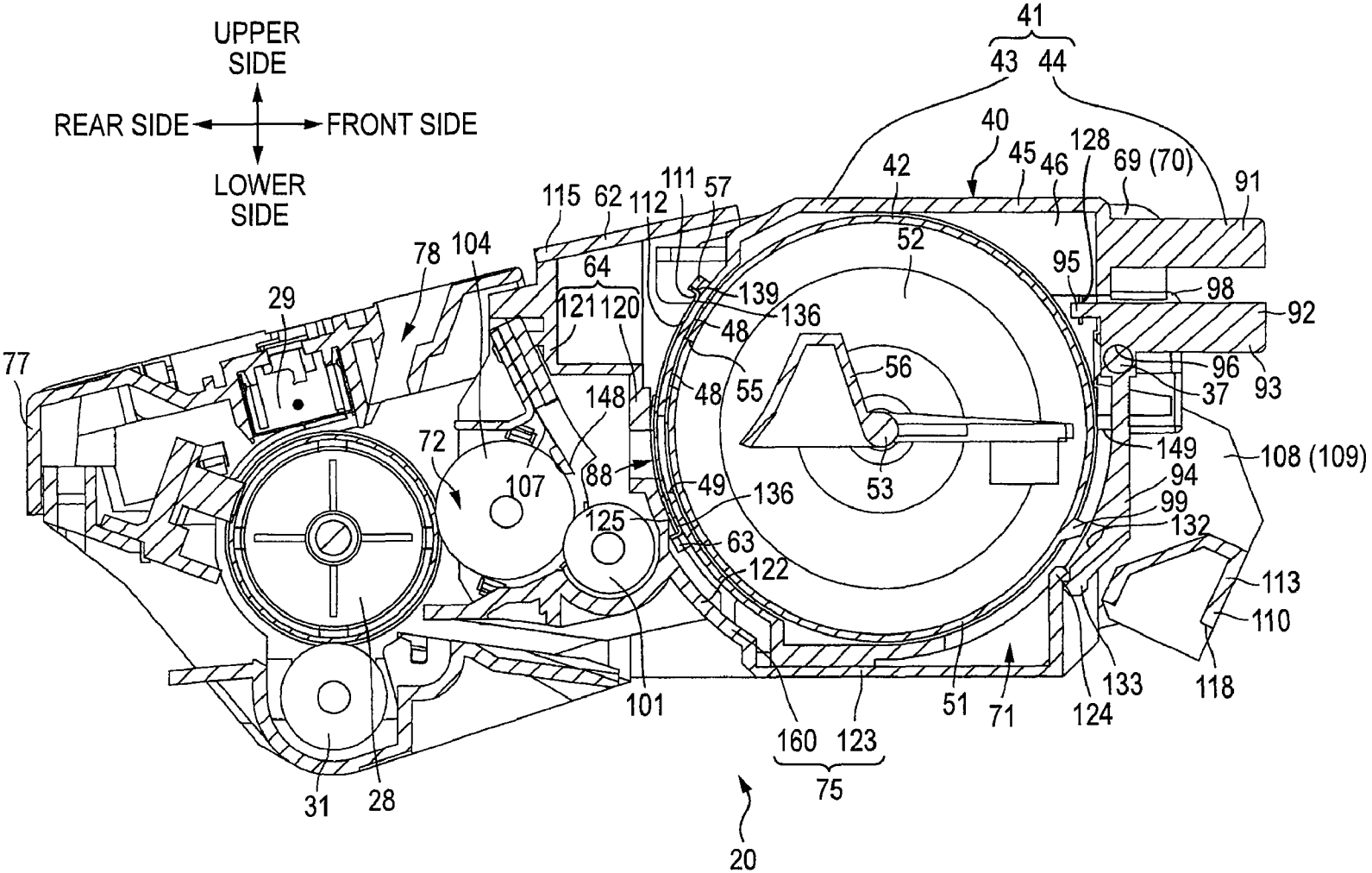
FIG. 10 is an exemplary left side sectional view of the process cartridge of FIG. 7 and showing a state where the swinging portion is in a third state.
Figures 11A, 11B, 11C, 11D:
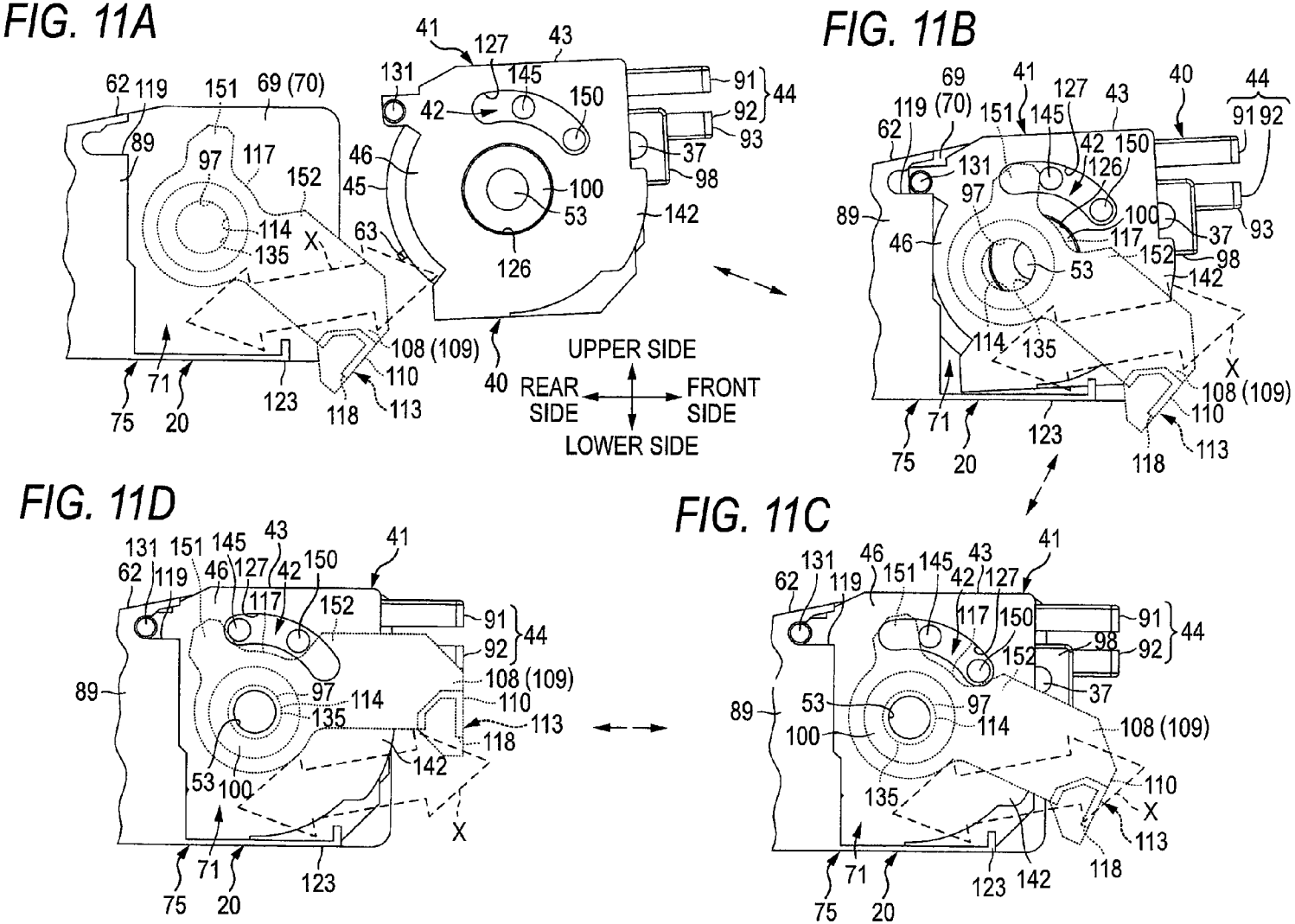

FIG. 8 is an exemplary left side sectional view of the process cartridge of FIG. 6. FIG. 9 is an exemplary left side sectional view of the process cartridge of FIG. 7 and showing a state where a swinging portion is in a second state. FIG. 10 is an exemplary left side sectional view of the process cartridge of FIG. 7 and showing a state where the swinging portion is in a third state. FIGS. 11A to 11D are schematic views of main portions of the process cartridge showing manners of attaching and detaching the toner cartridge and showing the vicinities of the opening/closing lever, and first width-direction projection and second width-direction projection. FIG. 11A shows a manner in which the toner cartridge is detached, and the opening/closing lever is at a first position. FIG. 11B shows a manner in which the toner cartridge is shifted from the attachment position in the detaching direction, and the opening/closing lever is at the first position. FIG. 11C shows a manner in which the toner cartridge is at the attachment position, and the opening/closing lever is at a third position. FIG. 11D shows a manner in which the toner cartridge is at the attachment position, and the opening/closing lever is at a second position.

As shown in FIG. 1, the process cartridge 20 is disposed below the scanner portion 19 in the body casing 2. The process cartridge 20 is detachably attached to the body casing 2 through the access port 6. As indicated by the thick arrow in the figure, directions of attaching/detaching the process cartridge 20 with respect to the body casing 2 are a rearward and obliquely downward direction (attaching direction) and a forward and obliquely upward direction (detaching direction).

As shown in FIG. 2, the process cartridge 20 includes a developing case 62 and a toner cartridge 40. The toner cartridge 40 is detachably attached to the developing case 62. As shown in FIG. 3, the process cartridge 20 further includes, in the developing case 62, the photosensitive drum 28, a scorotron charging device 29, the transfer roller 31, a supplying roller 101, a developing roller 104 and a layer-thickness restricting blade 107. The developing roller 104 is an example of a developer carrier.

(b-1) Developing Case

As shown in FIG. 2, a right side wall 69, a left side wall 70, a bottom wall 75, a rear side wall 77, a top wall 115 and a front side wall 64 (see FIG. 3) are integrally formed in the developing case 62.

The right side wall 69 and the left side wall 70 are opposed to each other in the width direction with forming a space therebetween. In each of the right and left side walls 69, 70, a first passage hole 70 which is passed through the right or left side wall 69, 70 in the width direction is formed in an intermediate portion in the forward and rearward direction.

The rear side wall 77 extends between the rear edges of the right and left side walls 69, 70.

The top wall 115 extends between the rear upper edges of the right and left side walls 69, 70. That is, the top wall 115 do not extend between the front upper edges of the right and left side walls 69, 70, and the upper side is opened in the front side of the developing case 62. A laser entrance hole 78 which allows the laser beam from the scanner portion 19 to be incident on the photosensitive drum 28 is formed in an intermediate portion in the forward and rearward direction of the top wall 115.

The front side wall 64 extends between the right and left side walls 69, 70. As shown in FIG. 3, the front side wall 64 integrally includes a vertical wall 120 and a bent wall 121. The vertical wall 120 extends upward from an intermediate portion in the forward and rearward direction of the bottom wall 75. The bent wall 121 is bent rearward from the upper edge of the vertical wall 120 and is again bent to upward extend to be connected to an intermediate portion in the forward and rearward direction of the top wall 115. The vertical wall 120 is formed such that the portion extending from the portion connected to the bottom wall 75 to an intermediate portion has a substantially inferior arc shape.

The bottom wall 75 extends between the lower edges of the right and left side walls 69, 70. A substantially front half of the bottom wall 75 integrally includes a first bottom wall portion 160 that is connected to the vertical wall 120 and a second bottom wall portion 123 that forward extends from the front edge of the first bottom wall portion 160. The first bottom wall portion 160 is formed such that a side section exhibits a substantially inferior arc shape, and the front edge of the portion is connected to the rear edge of the second bottom wall portion 123. The second bottom wall portion 123 has a substantially L-like side sectional shape that forward extends from the rear edge and is bent to extend upward. In a middle portion in the width direction of a front and upper end portion of the second bottom wall portion 123, an engaged portion 124 is integrally formed in a substantially middle portion in the width direction of a front and upper end portion of the second bottom wall portion 123. The engaged portion 124 has a substantially hook-like sectional shape in a side view which is bent at the upper edge of the second bottom wall portion and slightly extends forward.

Hereinafter, the substantially inferior arc portion of the vertical wall 120 and the first bottom wall portion 160 may be collectively referred to as a curved wall 122 (see FIG. 3).

As shown in FIG. 4A, a square column 89 is integrally formed on a width-direction inner side face of each of the right and left side walls 69, 70 and in the vicinity of a connecting position with respect to the vertical wall 120. The square column 89 has a substantially rectangular parallelepiped shape which is vertically elongated. A guide groove 119 in which a front end face is rearward recessed is formed in an upper end portion of the square column. A rib 90 is integrally formed on a width-direction inner side face of the square column 89 and below the guide groove 119. The rib 90 is projected to the inner side of the width direction such that a side sectional shape exhibits a substantially inferior arc shape. As shown in FIG. 8, the rib is placed so as to substantially extend along the curved wall 122 while forming a small gap in a radial direction with respect to the curved wall 122.

In the developing case 62, a portion defined by the right side wall 69, the left side wall 70, the front side wall 64, the first bottom wall portion 160 and the second bottom wall portion 123 of the bottom wall 75 is configured as a toner cartridge housing chamber 71 for housing the toner cartridge 40. The toner cartridge housing chamber 71 has a substantially bottomed frame-like shape in which the upper and front sides are opened.

The toner introduction port 88 is formed at the middle position in the width direction of the vertical wall 120. The toner introduction port 88 is an example of a second opening that penetrates through the vertical wall 120 in the thickness direction. The toner introduction port 88 has a substantially rectangular shape which is elongated in the width direction. The toner introduction port 88 causes the toner cartridge housing chamber 71 to communicate with a developing chamber 72. The developing chamber 72 is a portion defined by the right side wall 69, the left side wall 70, the front side wall 64 and the photosensitive drum 28.

The photosensitive drum 28 is rotatably supported between the right and left side walls 69, 70. The surfacemost layer is formed by a positive charging photosensitive layer.

The scorotron charging device 29 is supported by the top wall 115 on an obliquely upper rear side of the photosensitive drum 28. The scorotron charging device 29 is disposed so as to oppose to the photosensitive drum 28 with forming a gap so as not to be contacted therewith.

The transfer roller 31 is disposed below the photosensitive drum 28. The transfer roller 31 is placed so as to be vertically opposed to and contacted with the photosensitive drum 28 to form a nip between the roller and the photosensitive drum 28. The nip functions as the transferring position between the photosensitive drum 28 and the transfer roller 31. The transfer roller 31 is rotatably supported between the right and left side walls 69, 70.

The supplying roller 101 is placed in rear of and obliquely below the toner introduction port 88. The supplying roller 101 is rotatably supported between the right and left side walls 69, 70.

The developing roller 104 is elongated in the width direction. The developing roller 104 is placed in rear of and obliquely above the supplying roller 101 in a state where the developing roller is contacted with the supplying roller 101 so as to be mutually compressed. The developing roller 104 is rotatably supported between the right and left side walls 69, 70. The developing roller 104 is placed in front of the photosensitive drum 28 so as to be opposingly contacted therewith.

The layer-thickness restricting blade 107 is configured by a plate spring member and includes a pressing portion 148 having a substantially semicircular section shape, in a free end portion. A basal end portion of the layer-thickness restricting blade 107 is supported above the developing roller 104 by the developing case 62 in order to press contact the pressing portion 148 onto the developing roller 104 by the elastic force of the layer-thickness restricting blade 107.

(b-2) Shutter

The toner cartridge housing chamber 71 includes a shutter 111. The shutter 111 is an example of a second blocking member.

The shutter 111 is a thin plate formed as an inferior arc in which the peripheral length is slightly shorter than the curved wall 122, in a side sectional view. As shown in FIG. 4B, a through hole 112 is formed at the middle position in the width direction of the upper half of the shutter 111. The through hole 112 has a substantially rectangular shape in a front view and penetrates through the shutter 111 in the width direction. Cutaway portions 136, which are cut away in a substantially L-like shape in a front view, are formed in upper and lower end portions of both end portions in the width direction of the shutter 111, respectively. In the upper end portion of the shutter 111, engaged portions 139 which are to be engaged respectively with second radial projections 57 of the toner cartridge 40 in a state where the toner cartridge 40 is attached to the process cartridge 20 are disposed in inner sides in the width direction with respect to the cutaway portions 136, respectively.

As shown in FIG. 8, inside the toner cartridge housing chamber 71, both width-direction end portions of the shutter 111 are interposed between the curved wall 122 and the ribs 90 of the square column 89, whereby the shutter 111 is swingably supported along the side section shapes of the ribs 90 between the right and left side walls 69, 70.

The shutter 111 is swingable between a development closing position (see FIG. 8) where the toner introduction port 88 is closed by a portion of the shutter 111 in which the through hole 112 is not formed, i.e., in the closed state of the toner introduction port 88, and a development opening position (see FIG. 3) where the through hole 112 is opposed to the toner introduction port 88, thereby forward opening the toner introduction port 88. In a state where the toner cartridge 40 which will be described later is detached from the developing case 62, the shutter 111 is at the development closing position, and its swinging operation is restricted.

A seal member 125 is interposed between the curved wall 122 and the shutter 111. The seal member 125 made of felt or the like and having a substantially sheet-like shape is applied to the front side face of the curved wall 122 so as not to close the toner introduction port 88.

(b-3) Opening/Closing Lever

The toner cartridge housing chamber 71 includes the opening/closing lever 113. The opening/closing lever 113 is an example of an abutting member.

As shown in FIG. 4A, the opening/closing lever 113 has a substantially U-like shape in a plan view. A right supporting portion 108, a left supporting portion 109 and a lever gripping portion 110 are integrally formed in the opening/closing lever 113.

The right and left supporting portions 108, 109 are formed as a thin plate having a substantially P-like shape in a right side view. A circular hole 114 penetrating through the right or left supporting portion 108 or 109 in the thickness direction is formed at a substantially middle position of the rear half portion of each of the right and left supporting portions 108, 109.

In the outer side face in the width direction of each of the right and left supporting portions 108, 109, a support cylinder 135 which has the same inner diameter as the circular hole 114, and which is projected to the outside in the width direction is supported at a position corresponding to the circular hole 114. The outer diameter of the support cylinder 135 is slightly smaller than the inner diameter of a first through hole 97 formed in each of the right and left side walls 69, 70.

A receiving portion 117 in which the upper edge is recessed toward the circular hole 114 in a substantially U-like shape in a side view is formed in a portion which is above the circular hole 114 of each of the right and left supporting portions 108, 109. For the sake of convenience in description, in each of the right and left supporting portions 108, 109, a portion forming the rear edge of the receiving portion 117, i.e., that behind the receiving portion 117 is referred to as a rear portion 151, and that forming the front edge of the receiving portion 117, i.e., that before the receiving portion 117 is referred to as a front portion 152. The circle center of the circular hole 114 is positioned between the rear and front portions 151, 152 in the arrangement direction of the rear and front portions 151, 152 (the forward and rearward direction in FIG. 4A).

The lever gripping portion 110 is formed as a thin plate which has a substantially rectangular shape which is stretched between front end portions of the right and left supporting portions 108, 109, in a front view. A grip portion 118 which is an example of a first gripping portion, and in which the lower edge is upward recessed is formed at the middle position in the width direction of the lever gripping portion. In the lever gripping portion 110, abutting projections 141 which are projected toward the respective circular holes 114, and which have a substantially rectangular parallelepiped shape are formed in both wide-direction end portions of the side faces on the sides of the circular holes 114, respectively.

As shown in FIG. 4A, the support cylinders 135 of the right and left supporting portions 108, 109 are internally fitted in the first through holes 97 of the right and left side walls 69, 70, so that the opening/closing lever 113 is supported by the right and left side walls 69, 70 to be swingable about the circle center of the circular holes 114. The opening/closing lever 113 is swingable among the first position (see FIGS. 4C, 6, and 8, and FIGS. 11A and 11B) where the lever is deviated from an attachment/detachment path X of the toner cartridge 40 with respect to the developing case 62, the third position (see FIGS. 4B, 7, 9, and 10, and FIG. 11C) where the lever interferes with the attachment/detachment path X, and the second position (see FIGS. 2, 3, and 4A, and FIG. 11D). When the opening/closing lever 113 is at the first position, the lever gripping portion 110 is at the lowest position of the swinging range of the opening/closing lever 113, and below the attachment/detachment path X (see FIG. 8). When the opening/closing lever 113 is at the third position, the lever gripping portion 110 is at an intermediate position of the swinging range of the opening/closing lever 113, specifically, at a position which is higher in level than that in the case where the opening/closing lever 113 is at the first position, and an intermediate position of the attachment/detachment path X (see FIG. 9). When the opening/closing lever 113 is at the second position, the lever gripping portion 110 is at the highest position of the swinging range of the opening/closing lever 113, specifically, at a position which is higher in level than that in the case where the opening/closing lever 113 is at the third position, and an intermediate position of the attachment/detachment path X (see FIG. 3). While setting the right and left supporting portions 108, 109 as a reference, when the opening/closing lever 113 is at the second position, the right and left supporting portions 108, 109 extend in a substantially horizontal direction (see FIG. 11D). When the opening/closing lever 113 is at the third position, the right and left supporting portions 108, 109 are inclined with respect to the horizontal direction (see FIG. 11C). When the opening/closing lever 113 is at the first position, the right and left supporting portions 108, 109 are more inclined with respect to the horizontal direction than the case where the opening/closing lever 113 is at the third position (see FIGS. 11A and 11B). In this way, the third position is between the second and first positions. If the toner cartridge 40 is not attached to the developing case 62 (i.e., the cartridge is detached from the case), the opening/closing lever 113 is located at the first position by its own weight, and the receiving portions 117 are exposed to the front side (see FIG. 11A).

Irrespective of the position of the opening/closing lever 113, as shown in FIG. 3, the grip portion 118 is always exposed to the outside from the toner cartridge housing chamber 71 in a side view.

(b-4) Toner Cartridge

As described above, the toner cartridge 40 is detachably attached to the toner cartridge housing chamber 71 of the developing case 62. When the process cartridge 20 to which the toner cartridge 40 is attached is attached to or detached from the body casing 2 through the access port 6, the toner cartridge 40 can be attached to or detached from the body casing 2. If the process cartridge 20 is attached to the body casing 2, the toner cartridge 40 can be attached to or detached from the developing case 62. That is, the toner cartridge 40 alone can be attached to or detached from the body casing 2. The attaching/detaching direction of the toner cartridge 40 with respect to the developing case 62 of the process cartridge 20 is the rearward and obliquely downward direction (attaching direction) and forward and obliquely upward direction (detaching direction) which are near horizontal. The attachment/detachment path X is indicated in FIGS. 3, 8, 9, and 11A to 11D. A direction perpendicular to the attaching/detaching direction of the toner cartridge 40 with respect to the developing case 62 is the width direction.

The toner cartridge housing chamber 71 is positioned in front of the process cartridge 20. Therefore, when the front cover 7 is opened to open the access port 6, the toner cartridge 40 is exposed from the access port 6 as shown in FIG. 1.

As shown in FIG. 3, the toner cartridge 40 includes an outer case 41 and an inner case 42 which have a substantially σ-like shape in a left side sectional view and are made of a resin or the like. The outer case 41 and the inner case 42 are an example of a toner case.

(b-4-i) Outer Case

The outer case 41 has a substantially σ-like shape in a left side sectional view similar to that of the toner cartridge 40, and integrally includes a cylinder portion 43 and a guide lever 44.

As shown 5A, the cylinder portion 43 is formed as a hollow cylindrical member which is elongated in the width direction, and which has a substantially rectangular shape in a side view, and includes an outer peripheral wall 45, and a pair of outer side end walls 46 formed as both width-direction end faces of the outer peripheral wall 45.

A first toner discharging port 49 which is an example of a first opening that penetrates through the outer peripheral wall 45 in the thickness direction is formed at the middle position in the vertical and lateral directions of the rear side face of the outer peripheral wall 45. The first toner discharging port 49 is formed into a rectangular shape which is elongated in the width direction.

An upper guide groove 129 which penetrates through the outer peripheral wall 45 in the thickness direction is formed in each of width-direction end portions of the rear side face of the outer peripheral wall 45, at a level higher than the first toner discharging port 49. A lower guide groove 130 which penetrates through the outer peripheral wall 45 in the thickness direction is formed in each of width-direction end portions of the outer peripheral wall 45, at a level lower than the first toner discharging port 49. The upper and lower guide grooves 129, 130 have a rectangular shape in a rear view which is elongated in the circumferential direction, and are set so that their circumferential lengths are about twice the circumferential length of the first toner discharging port 49, and their axial lengths are about one half of the circumferential length of the first toner discharging port 49.

As shown in FIG. 6, a projection exposing hole 149 is formed at a substantially middle in the width direction of the front side face of the outer peripheral wall 45. The projection exposing hole 149 is formed into a rectangular shape, and penetrates through the outer peripheral wall 45 in the thickness direction.

Abutted members 142 are disposed in both width-direction end portions of a lower portion of the front side face of the outer peripheral wall 45. Each of the abutted members 142 is formed into a substantially arcuate shape in a left side view in which the member is forward projected from the front side face of the outer peripheral wall 45. The dimension of the member in the width direction is approximately equal to the width of the abutting projection 141 of the opening/closing lever 113.

As shown in FIG. 5A, a second through hole 126 which penetrates through each of the outer side end walls 46 in the width direction is formed at a substantially middle position in the vertical and lateral directions of each of the outer side end walls 46. In each of the outer side end walls 46, a through groove 127 is formed on the radially outer side of the second through hole 126, specifically, in a range from the 12 o'clock position to the 2 o'clock position in a left side view. The through grooves 127 have an inferior arc shape which is concentric with the second through hole 126, and penetrate in the width direction through the respective outer side end walls 46.

Positioning projections 131 are integrally formed on the outer side end walls 46, respectively. Each of the positioning projections rearward extends at a position corresponding to the upper edge of the upper guide groove 129, and is bent to be projected to the outside in the width direction. In the positioning projection 131, the portion which is projected to the outside in the width direction is formed into a columnar shape having an outer diameter which is smaller than the width of the guide groove 119 (see FIG. 4A) of the process cartridge 20.

The guide lever 44 is placed on an upper end portion of the front side face of the outer peripheral wall 45 and at the middle position in the width direction. As shown in FIG. 6, includes a toner cartridge-side gripping portion 91 which is an example of a second gripping portion, and the swinging portion 92.

The toner cartridge-side gripping portion 91 is formed into a substantially rectangular shape in a plan view which is elongated in the width direction. As shown in FIG. 8, a rear end portion of the gripping portion is fixed to the outer peripheral wall 45.

The swinging portion 92 is formed into a substantially rectangular shape in a plan view and a substantially T-like shape in a side sectional view, and integrally includes a grip 93, a first restricting portion 94, and a second restricting portion 95.

The grip 93 and the second restricting portion 95 are formed into a substantially rectangular shape in a plan view.

The first restricting portion 94 is formed into a substantially rectangular shape in a front view and a substantially J-like shape in a lift side sectional view. In a lower end portion of the first restricting portion, a first engaging portion 132 and a second engaging portion 133 are sequentially formed with starting from the upper side. The first engaging portion 132 is formed as a groove which is elongated in the width direction, in order to allow the rear side face of a lower portion of the first restricting portion 94 to be recessed toward the front side. The second engaging portion 133 is formed into a hook-like sectional shape in a left side sectional view in which the lower most end portion of the first restricting portion 94 is slightly bent toward the rear side below the first engaging portion 132.

A rear end portion of the grip 93, an upper end portion of the first restricting portion 94, and a front end portion of the second restricting portion 95 are connected to one another. A shaft through hole 96 which penetrates through the grip 93 and the first restricting portion 94 in the width direction is formed at a position where the rear end portion of the grip 93 is connected to the upper end portion of the first restricting portion 94.

The front side face of the outer peripheral wall 45 integrally includes a pair of shaft supporting portions 98 which are forward projected so as to sandwich the grip 93 of the swinging portion 92 in the width direction. A through shaft 37 which is stretched between the pair of shaft supporting portions 98 is passed through the shaft through hole 96 of the swinging portion 92, whereby the swinging portion 92 is swingably supported by the outer peripheral wall 45.

A rear end portion of the toner cartridge-side gripping portion 91 is coupled to the second restricting portion 95 of the swinging portion 92 by an elastic member 128. Specifically, the elastic member 128 is configured by a plate spring member or the like, one end portion of the member is screwed to the rear end portion of the toner cartridge-side gripping portion 91 by a screw 134, and the other end portion is engaged with the second restricting portion 95. Therefore, the swinging portion 92 is always urged in a clockwise direction in the figure about the through shaft 37 by an urging force of the elastic member 128 so that the second restricting portion 95 approaches the toner cartridge-side gripping portion 91.

(b-4-ii) Inner Case

As shown in FIG. 5C, the inner case 42 is formed into a hollow cylindrical shape which is elongated in the width direction, and which is smaller than the cylinder portion 43 of the outer case 41, and integrally includes: a cylindrical inner peripheral wall 51 which is an example of a first blocking member; and a pair of inner side end walls 52 which have a flat disk like shape, and which close the both width-direction side faces of the inner peripheral wall 51. As shown in FIG. 3, an agitator rotation shaft 53 is stretched between the centers of the inner side end walls 52 which are opposed to each other in the width direction. The agitator rotation shaft 53 is rotatably supported by the inner side end walls 52. As shown in FIG. 3, an agitator 56 is disposed on the agitator rotation shaft 53.

As shown in FIG. 5C, both width-direction end portions of the agitator rotation shaft 53 are projected to the outside in the width direction from the inner side end walls 52, respectively. Collars 100 having an outer diameter which is slightly smaller than the diameter of the second through hole 126 (see FIG. 5A) of the outer case 41 are externally fitted to the projected portions of the agitator rotation shaft 53, respectively.

In the inner side end walls 52, at positions which are on the radially outer side with respect to the agitator rotation shaft 53, and which are opposed to each other in the width direction, the first width-direction projections 145 which are an example of a first projecting portion, and the second width-direction projections 150 which are an example of a second projecting portion are respectively disposed.

The first width-direction projections 145 and the second width-direction projection 150 are formed into a columnar shape projected from the corresponding inner side end wall 52. Specifically, the radial directions of the first width-direction projections 145 and the second width-direction projection 150 are slightly smaller than the width of the through groove 127, and the projections are placed on the inner side end wall 52 while forming a gap therebetween in the circumferential direction of the inner peripheral wall 51. The gap is about one half of the circumferential length of the through groove 127 of the outer case 41. While setting FIG. 5C as a reference, the first width-direction projections 145 are located more rearward than the second width-direction projections 150. The first width-direction projections 145 of the inner side end walls 52 are opposed to each other in the width direction, and the second width-direction projections 150 of the inner side end walls 52 are opposed to each other in the width direction.

A second toner discharging port 55 which is an example of a third opening that penetrates through the inner peripheral wall 51 in the thickness direction is formed in one place on the circumference in the middle of the width direction of the inner peripheral wall 51, specifically, at a position which is shifted by about 90° in a counterclockwise direction with respect to the first width-direction projections 145 and the second width-direction projection 150. As viewed from the outer side in a radial direction, the second toner discharging port 55 is formed in a rectangular shape in which the dimensions are substantially identical with those of the first toner discharging port 49 of the outer case 41. The first width-direction projections 145 are positioned more closely to the second toner discharging port 55 than the second width-direction projections 150.

A first radial projection 48 which extends along the periphery of the second toner discharging port 55, and which is projected to the radially outer side is disposed on the inner peripheral wall 51. The first radial projection 48 has a rectangular frame-like shape as viewed from the outer side in a radial direction, and is formed by an elastic material such as rubber or a sponge sheet.

In both width-direction end portions of the inner peripheral wall 51, the second radial projections 57 which are an example of a second projection projected to the radially outer side are integrally disposed at positions which are slightly above the upper edge of the first radial projection 48, respectively. In the both width-direction end portions of the inner peripheral wall 51, third radial projections 63 which are an example of the second projection projected to the radially outer side are integrally disposed at positions which are below the lower edge of the first radial projection 48, respectively. The second radial projection 57 and the third radial projection 63 are formed in the same dimensions, and their lengths in the width direction are set so as to be smaller than the widths of the upper and lower guide grooves 129, 130 of the outer case 41.

As shown in FIG. 3, a fourth radial projection 99 which is projected to the radially outer side, and which is elongated in the width direction is formed in a position of the inner peripheral wall 51 which is opposite to the second toner discharging port 55 about the axial center of the inner case 42. The length in the width direction of the fourth radial projection 99 is set to be smaller than that of the projection exposing hole 149 of the outer case 41.

(b-4-iii) Installation of Inner Case into Outer Case

In the toner cartridge 40, the inner case 42 is housed in the outer case 41. As shown in FIG. 5A, the width-direction end portions of the agitator rotation shaft 53 of the inner case 42 are internally fitted together with the collars 100 into the second through holes 126 of the outer case 41, respectively. The first width-direction projections 145 and the second width-direction projection 150 of the inner case 42 are projected from the through grooves 127 of the outer case 41 toward the radially outer side of the inner case 42. The second radial projections 57 of the inner case 42 are projected from the upper guide grooves 129 of the outer case 41 toward the radially outer side of the inner case 42, and the third radial projections 63 of the inner case 42 are projected from the lower guide grooves 130 of the outer case 41 toward the radially outer side of the inner case 42. Furthermore, the fourth radial projection 99 of the inner case 42 is exposed into the projection exposing hole 149 of the outer case 41 (see FIG. 8).

Therefore, the inner case 42 is installed into the outer case 41, and the inner case 42 is swingably supported by the outer side end walls 46 of the outer case 41. Accordingly, the first width-direction projections 145 and the second width-direction projection 150 are slidable along the through grooves 127, the second radial projections 57 are slidable along the upper guide grooves 129, and the third radial projections 63 are slidable along the lower guide grooves 130.

When the assembled toner cartridge 40 is not attached to the process cartridge 20 as shown in FIG. 8, the first engaging portion 132 of the first restricting portion 94 of the outer case 41 is engaged with the fourth radial projection 99 of the inner case 42, whereby swinging of the inner case 42 with respect to the outer case 41 is restricted. The state of the swinging portion 92 at this time is referred to as the first state.

In the above-described first state, when the toner cartridge-side gripping portion 91 and the swinging portion 92 are gripped simultaneously, the swinging portion 92 is swung in a counterclockwise direction in the figure about the through shaft 37 against the urging force of the elastic member 128. After an elapse of a short time period from the simultaneous gripping of the toner cartridge-side gripping portion 91 and the swinging portion 92, the swinging of the swinging portion 92 stops. The state of the swinging portion 92 at this time is referred to as the second state.

In the second state, as shown in FIG. 9, the above-described first engaging portion 132 of the first restricting portion 94 is separated from the fourth radial projection 99 of the inner case 42, and the engagement between the first engaging portion 132 and the fourth radial projection 99 is canceled. However, the rear end portion of the second restricting portion 95 abuts against the inner peripheral wall 51 of the inner case 42. Hence, the swinging of the inner case 42 with respect to the outer case 41 is restricted.

Therefore, when the swinging portion 92 is in the third state which is between the first state and the second state, the engagement between the first engaging portion 132 and the fourth radial projection 99 is canceled as shown in FIGS. 3 and 10, and the rear end portion of the second restricting portion 95 does not abut against the inner peripheral wall 51 of the inner case 42. Therefore, the restriction on the swinging of the inner case 42 with respect to the outer case 41 is canceled. In this case, when the inner case 42 is swung with respect to the outer case 41, as shown in FIG. 5B, the first width-direction projections 145 and the second width-direction projections 150 are guided by the through grooves 127, the second radial projections 57 are guided by the upper guide grooves 129, and the third radial projections 63 are guided by the lower guide grooves 130. During the swinging operation of the inner case 42 with respect to the outer case 41, as shown FIG. 3, the first radial projection 48 of the inner case 42 is in sliding contact with the inner side face of the outer peripheral wall 45 of the outer case 41, whereby the interface between the outer case 41 and the inner case 42 is maintained air-tightly and liquid-tightly.

When the swinging portion 92 is in the third state, as shown in FIG. 5B, the inner case 42 can be moved to a toner closing position. At this time, the first toner discharging port 49 of the outer case 41 is closed by a portion of the inner peripheral wall 51 other than the second toner discharging port 55. That is, the first toner discharging port 49 is in the closed state, and the interiors of the outer case 41 and the inner case 42 are hermetically sealed. The second radial projections 57 abut against the upper edges of the upper guide grooves 129, the third radial projections 63 abut against the upper edges of the lower guide grooves 130, and the second width-direction projections 150 abut against the front edges of the through grooves 127. The first width-direction projections 145 are separated from the rear edges of the through grooves 127. In contrast, the inner case 42 can be moved to a toner opening position shown in FIG. 5A where the first toner discharging port 49 is opened and opposed to the second toner discharging port 55 to the interiors of the outer case 41 and the inner case 42. The second radial projections 57 abut against the lower edges of the respective upper guide grooves 129, the third radial projections 63 abut against the lower edges of the lower guide grooves 130, and the first width-direction projections 145 abut against the rear edges of the through grooves 127. The second width-direction projections 150 are separated from the front edges of the through grooves 127. As described above, the first toner discharging port 49 is opened and closed by the inner peripheral wall 51 of the inner case 42.

In the inner case 42, as developer, nonmagnetic single-component toner having a positive chargeability is housed in the inner case 42.

(b-5) Attachment and Detachment of Toner Cartridge to and from Process Cartridge (b-5-i) Attachment of Toner Cartridge to Process Cartridge The toner cartridge 40 in which the inner case 42 is at the toner closing position is attached along the attachment/detachment path X to the toner cartridge housing chamber 71 of the developing case 62 of the process cartridge 20 in which, as shown in FIG. 11A, the opening/closing lever 113 is at the first position, and the shutter 111 is at the development closing position. At this time, the positioning projections 131 of the toner cartridge 40 are guided by the guide grooves 119 in the toner cartridge housing chamber 71 of the process cartridge 20. The swinging portion 92 of the toner cartridge 40 is in the first state (see FIG. 8), and the swinging of the inner case 42 with respect to the outer case 41 is restricted.

On the way of attachment of the toner cartridge 40, as shown in FIG. 11B, the first width-direction projections 145 abut from the front side against the rear edges of the corresponding receiving portions 117 of the opening/closing lever 113, i.e., the rear portions 151 of the corresponding light or left supporting portion 108, 109. When the toner cartridge 40 is further moved in the attaching direction, the first width-direction projections 145 forward push the rear portions 151. In accordance therewith, the lever gripping portion 110 which is on the side opposite to the rear portions 151 with respect to the rotation shaft of the opening/closing lever 113 is swung about the rotation shaft of the opening/closing lever 113 to be raised. That is, the opening/closing lever 113 which is at the first position is swung toward the third position.

When the positioning projections 131 reach and abut against the innermost portions of the guide grooves 119, the attachment of the toner cartridge 40 to the developing case 62 is completed. At this time, as shown in FIG. 11C, the pushing of the first width-direction projections 145 against the rear portions 151 is stopped. In accordance therewith, the swinging of the opening/closing lever 113 is also stopped. At this time, the opening/closing lever 113 is at the third position. The first width-direction projections 145 continue to abut from the front side against the rear portions 151, and the second width-direction projections 150 abut from the front side against the front edges of the corresponding receiving portions 117 of the opening/closing lever 113, i.e., the front portions 152. In accordance with the attachment of the toner cartridge 40 to the developing case 62, the first width-direction projections 145 push the opening/closing lever 113 to swing the opening/closing lever 113 from the first position to the third position, and the first width-direction projections 145 and the second width-direction projections 150 engage with the opening/closing lever 113 in the receiving portions 117. As shown in FIG. 9, the second radial projections 57 of the toner cartridge 40 are engaged with the engaged portions 139 of the shutter 111 of the toner cartridge housing chamber 71, and the shutter 111 is clamped in the swinging direction between the second radial projections 57 and the third radial projections 63. The second engaging portion 133 is engaged with the engaged portion 124, whereby the swinging portion 92 is set to the third state (see FIG. 10).

As a result, the operation of attaching the toner cartridge 40 to the developing case 62 is completed, and the position of the toner cartridge 40 at this time is set as the attachment position. If the toner cartridge 40 is at the attachment position, as shown in FIG. 9, the grip portion 118 of the opening/closing lever 113 which is at the third position is separated by a predetermined gap from the toner cartridge-side gripping portion 91 of the toner cartridge 40. As shown in FIG. 7, the abutting projection 141 of the lever gripping portion 110 are opposed to and slightly contacted with the front side faces of the corresponding abutted members 142 of the toner cartridge 40.

If the attachment of the toner cartridge 40 to the developing case 62 is completed, the swinging portion 92 is at the third state. Hence, the inner case 42 is swingable with respect to the outer case 41. Therefore, when the opening/closing lever 113 is swung from the third position to the second position (see FIG. 2 and FIG. 11D), the inner case 42 which is engaged with the opening/closing lever 113 by the first width-direction projections 145 and the second width-direction projections 150 is swung from the toner closing position (see FIG. 10) to the toner opening position (see FIG. 3) in conjunction with the swinging of the opening/closing lever 113. In the receiving portions 117, specifically, the second width-direction projections 150 are pushed by the opening/closing lever 113 along the direction of the swinging from the third position to the second position, whereby the inner case 42 is swung.

Therefore, as shown in FIG. 3, the first toner discharging port 49 is opened in accordance with the swinging of the opening/closing lever 113 to open-operate the inner peripheral wall 51, and the first toner discharging port 49 and the second toner discharging port 55 are opposed to each other to communicate with each other. In conjunction with the swinging of the inner case 42, i.e., in conjunction with the swinging of the first width-direction projections 145 and the second width-direction projections 150, also the shutter 111 which is clamped between the second radial projections 57 of the inner case 42 and the third radial projections 63 is swung from the development closing position (see FIG. 9) to the development opening position in accordance with the swinging of the opening/closing lever 113. As a result, the through hole 112 of the shutter 111 is opposed to the toner introduction port 88 of the toner cartridge housing chamber 71, and the toner introduction port 88 is opened. In this way, the operation of opening the toner introduction port 88 by the shutter 111 is performed through the operation in which the first toner discharging port 49 is opened by the inner peripheral wall 51 of the inner case 42. Specifically, when the inner peripheral wall 51 of the inner case 42 is swung, the opening/closing lever 113 swings the shutter 111, and then performs the opening operation on the shutter 111 and the inner peripheral wall 51.

In accordance with the swinging of the opening/closing lever 113 from the third position to the second position, the lever gripping portion 110 is upward swung. Therefore, when the opening/closing lever 113 is at the second position, the grip portion 118 is adjacent to the toner cartridge-side gripping portion 91.

If the opening/closing lever 113 is at the second position, the shutter 111 is at the development opening position, and the inner case 42 is at the toner opening position. Therefore, the through hole 112 and toner introduction port 88 which are in the opposed state in the toner cartridge housing chamber 71 are opposed to and communicate with the first toner discharging port 49 and the second toner discharging port 55 which are in the opposed state in the toner cartridge 40. Therefore, the interior of the inner case 42 of the toner cartridge 40 communicates with that of the developing chamber 72 of the developing case 62 through the toner introduction port 88, the through hole 112, and the first toner discharging port 49 and the second toner discharging port 55.

As described above, the interface between the outer case 41 in which the first toner discharging port 49 is formed, and the inner case 42 in which the second toner discharging port 55 is formed is maintained air-tightly and liquid-tightly by the first radial projection 48, and the seal member 125 is interposed between the shutter 111 in which the through hole 112 is formed, and the curved wall 122 in which the toner introduction port 88 is formed. Therefore, the toner is prevented from leaking to the outside from the toner introduction port 88, the through hole 112, and the first toner discharging port 49 and the second toner discharging port 55.

When the lever gripping portion 110 is swung in accordance with the swinging of the opening/closing lever 113 from the third position to the second position as described above, as shown in FIG. 2, the abutting projection 141 of the lever gripping portion 110 is upward swung while passing over the front side face of the abutted members 142. When the swinging of the opening/closing lever 113 to the second position is completed, the abutting projections 141 of the lever gripping portion 110 abut (referred to as "abut" in distinction from "contact" at the third position) against an upper end portion of the front side face of the abutted members 142 from the front side (the downstream side in the direction along which the toner cartridge 40 is detached from the developing case 62) with respect to the abutted members 142 at a contact pressure which is higher than that exerted when the opening/closing lever 113 is at the third position (see FIG. 7). Therefore, even when a force of moving the toner cartridge 40 in the detaching direction (front side) is applied to the toner cartridge 40, the forward relative forward movement of the toner cartridge 40 with respect to the developing case 62 can be restricted. Accordingly, the state of attaching the toner cartridge 40 to the developing case 62 can be surely maintained.

(b-5-ii) Detachment of Toner Cartridge from Process Cartridge

If the shutter 111 is at the development opening position and the inner case 42 is at the toner opening position, the opening/closing lever 113 which is at the second position is swung to the third position as shown in FIG. 10. Therefore, as shown in FIGS. 11C and 11D, in the receiving portions 117, the first width-direction projections 145 are pushed by the opening/closing lever 113 along the direction of the swinging from the second position to the third position, whereby the inner case 42 is swung. In conjunction of the swinging of the opening/closing lever 113, as shown in FIG. 10, the inner case 42 is swung from the toner opening position to the toner closing position. In accordance with the swinging of the opening/closing lever 113, the inner peripheral wall 51 is close-operated, and the first toner discharging port 49 of the outer peripheral wall 45 of the outer case 41 is closed by a portion of the inner peripheral wall 51 of the inner case 42 other than the second toner discharging port 55. Therefore, the communication between the first toner discharging port 49 and the second toner discharging port 55 is blocked, and the interiors of the outer case 41 and the inner case 42 are hermetically sealed. In conjunction with the swinging of the inner case 42, i.e., the swinging of the first width-direction projections 145 and the second width-direction projections 150, also the second radial projection 57 and the third radial projection 63 are swung. Therefore, the shutter 111 which is clamped between the second radial projection 57 and the third radial projection 63 is swung from the development opening position to the development closing position. As a result, the toner introduction port 88 of the toner cartridge housing chamber 71 is closed by a portion of the shutter 111 other than the through hole 112. In this way, if the opening/closing lever 113 is at the third position, the first toner discharging port 49 and the toner introduction port 88 are closed, and the communication between the first toner discharging port 49 and the toner introduction port 88 is blocked. The operation of closing the toner introduction port 88 by the shutter 111 is performed through the operation in which the first toner discharging port 49 is closed by the inner peripheral wall 51 of the inner case 42. When the opening/closing lever 113 is swung from the second position to the third position, the opening/closing lever 113 causes the shutter 111 and the inner peripheral wall 51 to perform the closing operation.

In accordance with the swinging of the opening/closing lever 113 to the third position, the lever gripping portion 110 is downward swung. Therefore, as shown in FIG. 7, the abutting projections 141 of the lever gripping portion 110 are downward swung while overriding the front faces of the abutted members 142. When the swinging of the opening/closing lever 113 to the third position is completed, the abutting projections 141 are opposed to and slightly contacted with the front faces of the abutted members 142. That is, when the opening/closing lever 113 is at the third position, the abutting state of the abutting projections 141 against the abutted members 142 is canceled.

If the opening/closing lever 113 is swung to the third position, as shown in FIG. 10, the first restricting portion 94 is in the third state, and the second engaging portion 133 is engaged with the engaged portion 124. Therefore, as shown in FIG. 9, the swinging portion 92 is swung to the second state to cancel the engagement between the second engaging portion 133 and the engaged portion 124. While maintaining the swinging portion 92 to be in the second state (while maintaining the swinging portion 92 to be gripped), the toner cartridge 40 is pulled out from the toner cartridge housing chamber 71 in the forward and obliquely upward direction. At this time, the positioning projections 131 (see FIG. 6) of the toner cartridge 40 are guided by the guide grooves 119 (see FIG. 6) in the toner cartridge housing chamber 71. When the hand is released from the pulled-out toner cartridge 40, the swinging portion 92 is set to the first state (see FIG. 8).

When, as shown in FIG. 8, the positioning projections 131 are disengaged from the guide grooves 119, the engagements (see FIG. 7) between the first width-direction projections 145 and the second width-direction projections 150 and the receiving portions 117 are cancelled, and the engagements between the second radial projections 57 and the engaged portions 139 are cancelled, the operation of detaching the toner cartridge 40 from the developing case 62 of the process cartridge 20 is completed.

When, as shown in FIG. 11C, the opening/closing lever 113 which is at the third position is further swung to the first position shown in FIG. 11B, the rear portions 151 of the opening/closing lever 113 are swung about the rotation shaft of the opening/closing lever 113, or specifically, moved to the front side. Therefore, the first width-direction projections 145 engaged with the receiving portions 117 are pushed from the rear side toward the front side by the corresponding rear portions 151. The forward pushing force is applied to the whole toner cartridge 40 through the first width-direction projections 145 to forward move the toner cartridge 40. Specifically, the pushing force causes the above-mentioned engagement (see FIG. 10) between the second engaging portion 133 and the engaged portion 124 to be compulsively canceled, and the toner cartridge 40 to be moved from the attachment position (see FIG. 11C) in the detaching direction (front side) (FIG. 11B). In other words, when the opening/closing lever 113 which is at the third position is swung to the first position, the first width-direction projections 145 cause the toner cartridge 40 to be moved from the attachment position in the detaching direction. Then, the hand is shifted from the opening/closing lever 113 to the guide lever 44, and the toner cartridge 40 is pulled out in the forward and obliquely upward direction. As described above, when the positioning projections 131 are disengaged from the guide grooves 119, the engagements (see FIG. 7) between the first width-direction projections 145 and the second width-direction projections 150 and the receiving portions 117 are cancelled, and the engagements between the second radial projections 57 and the engaged portions 139 are cancelled, the operation of detaching the toner cartridge 40 from the developing case 62 of the process cartridge 20 is completed.

(b-6) Developing and Transferring Operations

As described in (b-5-i) above and as shown in FIG. 3, the toner cartridge 40 is attached to the developing case 62 of the process cartridge 20 to be housed in the toner cartridge housing chamber 71. When an image forming process is to be thereafter performed by the laser printer 1, a driving force from a motor (not shown) is applied to the agitator rotation shaft 53. Then, the agitator rotation shaft 53 is rotated in a clockwise direction in a left side view, and the agitator 56 is circumferentially moved in the inner case 42 of the toner cartridge 40, about the agitator rotation shaft 53. As a result, the toner in the toner cartridge 40 is stirred by the agitator 56, and supplied to the first toner discharging port 49 through the second toner discharging port 55. Thereafter, the toner is supplied to the developing case 62 through the first toner discharging port 49, and received by the through hole 112, and the toner introduction port 88 to be discharged into the developing chamber 72.

The toner which is discharged into the developing chamber 72 through the toner introduction port 88 is supplied to the developing roller 104 by the rotation of the supplying roller 101. At this time, the toner is frictionally charged to the positive polarity between the supplying roller 101 and the developing roller 104. In accordance with the rotation of the developing roller 104, the toner which is supplied onto the developing roller 104 enters between the pressing portion 148 of the layer-thickness restricting blade 107 and the developing roller 104, and carried as a thin layer of a constant thickness on the developing roller 104.

In accordance with the rotation of the photosensitive drum 28, the surface of the photosensitive drum 28 is first uniformly charged to the positive polarity by the scorotron charging device 29, and then exposed by high speed scanning of the laser beam from the scanner portion 19, so that an electrostatic latent image corresponding to an image to be formed on the sheet 3 is formed.

Next, the rotation of the developing roller 104 causes the toner which is carried on the developing roller 104, and which is charged to the positive polarity, to be opposed and contacted to the photosensitive drum 28. At this time, the toner is supplied to the electrostatic latent image formed on the surface of the photosensitive drum 28. Therefore, the electrostatic latent image on the photosensitive drum 28 is converted to a visible image, so that a toner image formed by reversal development is carried on the surface of the photosensitive drum 28.

During a period when the sheet 3 conveyed by the registering roller 15 (see FIG. 1) is passed through the transferring position between the photosensitive drum 28 and the transfer roller 31, the toner image carried on the surface of the photosensitive drum 28 is then transferred to the sheet 3 by a transfer bias applied to the transfer roller 31. The sheet 3, onto which the toner is transferred, is conveyed to the fixing portion 21.

(c) Fixing Portion

As shown in FIG. 1, the fixing portion 21 is disposed behind the process cartridge 20. The fixing portion 21 is placed while forming a gap in the forward and rearward direction between the portion and the photosensitive drum 28 of the process cartridge 20. The fixing portion 21 includes a heating roller 60 and a pressurizing roller 61.

In the fixing portion 21, the toner image transferred onto the sheet 3 at the transferring position is thermally fixed during a period when the sheet 3 is passed through between the heating roller 60 and the pressurizing roller 61. The sheet 3 onto which the toner image is fixed is conveyed to a discharge-side conveying path to be conveyed by a conveying roller 155 toward a discharging roller 47, and then discharged by the discharging roller 47 onto a discharge tray 58. The discharge tray 58 is formed on the upper face of the body casing 2.

In the process cartridge 20, the opening/closing lever 113 is disposed on the developing case 62 of the process cartridge 20. Therefore, when the toner cartridge 40 is not attached to the developing case 62 of the process cartridge 20 as shown in FIG. 8, the opening/closing operations of the inner peripheral wall 51 disposed on the toner cartridge 40 are restricted. Accordingly, the first toner discharging port 49 can be prevented from being accidentally opened or closed.

Further, in the process cartridge 20, the opening/closing lever 113 which is swingably disposed on the developing case 62 abuts against the toner cartridge 40 from the downstream side (front side) in the direction along which the toner cartridge 40 is detached from the developing case 62 as shown in FIG. 3. Therefore, even when a force of moving the toner cartridge 40 in the detaching direction (front side) is applied to the toner cartridge 40, the relative forward movement of the toner cartridge 40 with respect to the developing case 62 can be restricted. Accordingly, the state of attaching the toner cartridge 40 to the developing case 62 can be surely maintained.

When the toner cartridge 40 is attached to the developing case 62 as shown in FIG. 3, the opening/closing lever 113 can open and close the inner peripheral wall 51 and the shutter 111. Therefore, if the toner cartridge 40 is attached to the developing case 62, the opening/closing lever 113 is swung to open the inner peripheral wall 51 and the shutter 111, the first toner discharging port 49 and the toner introduction port 88 are opened to communicate with each other so that the toner can be supplied from the toner cartridge 40 to the developing case 62. If the toner cartridge 40 is attached to the developing case 62 as shown in FIG. 10, the opening/closing lever 113 is swung to close the first toner discharging port 49 and the toner introduction port 88. Further, the first toner discharging port 49 and the toner introduction port 88 are closed to block communication between the first toner discharging port 49 and the toner introduction port 88. Therefore, the toner cartridge 40 can be detached from the developing case 62 without causing the toner to leak from the first toner discharging port 49 and the toner introduction port 88. Accordingly, the toner can be prevented from leaking from the toner cartridge 40 and the process cartridge 20 by the simple configuration and the easy operation.

The opening/closing lever 113 is swingable among the first position, the second position, and the third position which is between the first width-direction projections 145 and the second width-direction projections 150. When the opening/closing lever 113 is at the first position, the state where the toner cartridge 40 is detached from the developing case 62 and the toner introduction port 88 is closed is attained as shown in FIG. 8. When the opening/closing lever 113 is at the second position, the toner cartridge 40 is attached to the developing case 62 as shown in FIG. 3, and the first toner discharging port 49 and the toner introduction port 88 are opened to communicate with each other. When the opening/closing lever 113 is at the third position, the toner cartridge 40 is attached to the developing case 62 as shown in FIG. 10, and the first toner discharging port 49 and the toner introduction port 88 are closed to block communication between the first toner discharging port 49 and the toner introduction port 88. In accordance with the attachment of the toner cartridge 40 to the developing case 62, the opening/closing lever 113 is swung from the first position to the third position as shown in FIGS. 11B and 11C. At this time, the opening/closing lever 113 is swung from the first position to the third position while maintaining the state where the communication between the first toner discharging port 49 and the toner introduction port 88 (see FIG. 10). Accordingly, the first position can be set to a position which, in the attaching and detaching operations, is separated from the hand gripping the toner cartridge 40, and the third position can be set to a position which is close to the gripping hand. Therefore, the degree of freedom in design can be enhanced. In this case, the opening/closing lever 113 at the third position approaches the gripping hand, and the operation is facilitated.

As a result, the degree of freedom in design can be enhanced, and the toner can be prevented from leaking by the simple configuration and the easy operation.

As shown in FIGS. 11A to 11D, the toner cartridge 40 includes the first width-direction projections 145. In accordance with attachment of the toner cartridge 40 to the developing case 62, the first width-direction projections 145 push the opening/closing lever 113 to swing the opening/closing member from the first position to the third position as shown in FIGS. 11B and 11C. Therefore, by simply providing the first width-direction projections 145 to the toner cartridge 40, the opening/closing lever 113 can swing from the first position to the third position in accordance with attachment of the toner cartridge 40 to the developing case 62.

Moreover, before the opening/closing lever 113 is pushed by the first width-direction projections 145, the opening/closing lever is placed at the first position as shown in FIGS. 11A and 11B. Hence, the attachment/detachment path X for the toner cartridge 40 is ensured. Therefore, smooth attachment and detachment of the toner cartridge 40 with respect to the developing case 62 can be ensured.

As shown in FIG. 11B, the opening/closing lever 113 which is at the first position is deviated from the attachment/detachment path X. Hence, the opening/closing lever 113 is located at a position which is remote from a gripping hand for gripping the toner cartridge 40 in the attaching/detaching operations, and in which the lever is difficult to operate. However, in accordance with attachment of the toner cartridge 40 to the developing case 62, the first width-direction projections 145 swing the opening/closing lever 113 from the first position to the third position where the lever interferes with the attachment/detachment path X as shown in FIG. 11C. Hence, the opening/closing lever 113 at the third position approaches the gripping hand, and is easy to operate. Therefore, the easy operation can cause the opening/closing lever 113 to abut against the toner cartridge 40 to surely maintain the state where the toner cartridge 40 is attached to the developing case 62. Moreover, the opening/closing lever 113 is pushed by the first width-direction projections 145 to be placed at the third position. Hence, the attachment/detachment path X for the toner cartridge 40 is blocked. Also because of this reason, the relative forward movement of the toner cartridge 40 attached to the developing case 62 can be restricted.

As a result, while ensuring smooth attachment and detachment of the toner cartridge 40 with respect to the developing case 62, the state of attaching the toner cartridge 40 to the developing case 62 can be surely maintained by the easy operation.

The opening/closing lever 113 can be swung from the third position shown in FIG. 11C to the second position where the lever abuts against the toner cartridge 40 attached to the developing case 62 as shown in FIG. 11D. Therefore, when the opening/closing lever 113 is at the second position, the state where the toner cartridge 40 is attached to the developing case 62 can be surely maintained by the simple operation in which the opening/closing lever 113 is simply swung.

As shown in FIG. 5, as an example of the tone case, the toner cartridge 40 includes the outer case 41 in which the first toner discharging port 49 is formed, and the inner case 42 which is housed swingably with respect to the outer case 41, which includes the inner peripheral wall 51, in which the second toner discharging port 55 for supplying the toner to the first toner discharging port 49 is formed, and which houses the toner. Accordingly, the toner cartridge 40 can have a double structure which includes the outer case 41 and the inner case 42.

The inner case 42 includes the second width-direction projections 150. In accordance with swinging of the opening/closing lever 113 from the third position to the second position, the second width-direction projections 150 is pushed by the opening/closing lever 113 as shown in FIGS. 11C and 11D. Accordingly, the second width-direction projections 150 swing the inner case 42 as shown in FIG. 3 to cause the inner peripheral wall 51 to perform an operation of opening the inner peripheral wall 51, thereby communicating the first toner discharging port 49 with the second toner discharging port 55. Therefore, by simply providing the second width-direction projections 150 to the inner case 42, the toner housed in the inner case 42 of the toner cartridge 40 can be supplied to the developing case 62 when the opening/closing lever 113 is swung from the third position to the second position.

That is, when the opening/closing lever 113 is swung from the third position to the second position, the supply of the toner housed in the inner case 42 of the toner cartridge 40 is enabled in addition to the maintenance of the state where the toner cartridge 40 is attached to the developing case 62. As a result, operability can be improved.

In contrast, when the opening/closing lever 113 is swung from the third and second positions shown in FIGS. 11C and 11D to the first position shown in FIG. 11B, the first width-direction projections 145 are pushed by the opening/closing lever 113, whereby the toner cartridge 40 is moved from the attachment position with respect to the developing case 62 in the detaching direction. When the opening/closing lever 113 is placed at the third and second positions shown in FIGS. 11C and 11D, the attachment/detachment path X for the toner cartridge 40 is blocked. Thus, the relative movement in the detaching direction of the toner cartridge 40 attached to the developing case 62 can also be restricted. When the opening/closing lever 113 is swung to the first position shown in FIG. 11B, the attachment/detachment path X for the toner cartridge 40 is ensured. Therefore, smooth attachment and detachment of the toner cartridge 40 with respect to the developing case 62 can be ensured.

When the opening/closing lever 113 is at the second position, the grip portion 118 of the opening/closing lever 113 is adjacent to the toner cartridge-side gripping portion 91 of the toner cartridge 40. Hence, the grip portion 118 and the toner cartridge-side gripping portion 91 can be gripped together. Therefore, the relative position between the developing case 62 in which the opening/closing lever 113 is disposed, and the toner cartridge 40 is stabilized. Accordingly, the process cartridge 20 can be moved in a stable state.

On the other hand, when the opening/closing lever 113 is swung from the third position to the first position, the toner cartridge 40 is moved from the position where the toner cartridge is attached to the developing case 62, in the detaching direction as shown in FIGS. 11B and 11C. Accordingly, the toner cartridge 40 can be detached from the developing case 62 while maintaining the state where the communication between the first toner discharging port 49 and the toner introduction port 88 (see FIG. 10) is blocked, by the simple operation of swinging the opening/closing lever 113 from the third position to the first position. Furthermore, the first position can be set to a position where the operations of attaching and detaching the toner cartridge 40 are not obstructed. Therefore, the degree of freedom in design can be enhanced.

As a result, the degree of freedom in design can be enhanced, and the toner can be prevented from leaking by the simple configuration and the easy operation.

Furthermore, while ensuring smooth attachment and detachment of the toner cartridge 40 with respect to the developing case 62, the state of attaching the toner cartridge 40 to the developing case 62 can be surely maintained by the easy operation.

When the opening/closing lever 113 is swung from the third position to the first position, the first width-direction projections 145 are pushed by the opening/closing lever 113, whereby the toner cartridge 40 is moved from the position where the toner cartridge is attached to the developing case, in the detaching direction. Therefore, by simply providing the first width-direction projections 145 to the toner cartridge 40, the toner cartridge 40 can be moved from the position where the toner cartridge is attached to the developing case 62 in the detaching direction when the opening/closing lever 113 is swung from the third position to the first position.

Further, when the opening/closing lever 113 is at the second position, the state where the toner cartridge 40 is attached to the developing case 62 can be surely maintained by the simple operation in which the opening/closing lever 113 is simply swung. On the other hand, when the opening/closing lever 113 is at the third position, the maintenance of the attachment state is canceled, and the toner cartridge 40 can be attached to or detached from the developing case 62.

The first width-direction projections 145 are disposed on the inner case 42. In accordance with swinging of the opening/closing lever 113 from the second position to the third position, is pushed by the opening/closing lever 113 as shown in FIGS. 11C and 11D. Accordingly, the first width-direction projections 145 swing the inner case 42, whereby the inner peripheral wall 51 is close-operated to close the first toner discharging port 49 and block communication between first toner discharging port 49 and the second toner discharging port 55. Therefore, by simply providing the first width-direction projections 145 to the inner case 42, the supply of the toner housed in the inner case 42 of the toner cartridge 40 to the developing case 62 can be restricted when the opening/closing lever 113 is moved from the second position to the third position.

When the opening/closing lever 113 is swung from the second position to the third position, furthermore, the supply of the toner housed in the inner case 42 of the toner cartridge 40 to the developing case 62 can be restricted in addition to cancellation of the maintenance of the state where the toner cartridge 40 is attached to the developing case 62. As a result, operability can be improved.

The opening/closing lever 113 is swingably supported by the right and left side walls 69, 70 whish are the both side walls of the developing case 62 in the longitudinal direction (width direction) of the developing roller 104. Therefore, the lever can be stably swung.

When the toner cartridge 40 is attached to and detached from the developing case 62 in the width direction, the toner cartridge 40 easily interferes with the opening/closing lever 113 supported by the right and left side walls 69, 70. Thus, it is difficult to perform smooth attachment and detachment of the toner cartridge 40 with respect to the developing case 62. However, as described above, the toner cartridge 40 is attached to and detached from the developing case 62 in the direction perpendicular to the width direction. Therefore, if the opening/closing lever 113 is supported by the right and left side walls 69, 70, the toner cartridge 40 does not interfere with the opening/closing lever 113, and smooth attachment and detachment of the toner cartridge 40 with respect to the developing case 62 can be ensured.

When the toner cartridge 40 is detached from the developing case 62, even when the opening/closing lever 113 is operated as shown in FIG. 8, the developing case 62 can be maintained to the state where the shutter 111 closes the toner introduction port 88. Further, the toner cartridge 40 can be maintained to the state where the inner peripheral wall 51 closes the first toner discharging port 49.

As described above, the toner cartridge 40 is attachable to and detachable from the developing case 62 in the direction perpendicular to the longitudinal direction (width direction) of the developing roller 104. Therefore, the first toner discharging port 49 and the toner introduction port 88 can be disposed so as to be opposed to the developing roller 104 as shown in FIG. 3 in the state where the toner cartridge 40 is attached to the developing case 62. Therefore, the placement positions and sizes of the first opening and the second opening can be freely set. That is, the toner can be surely supplied from the toner cartridge 40 to the developing case 62.

Further, the inner peripheral wall 51 is swingably supported by the both side walls (the outer side end walls 46) of the toner cartridge 40. Thus, the first toner discharging port 49 can be stably opened and closed. When a portion of supporting the inner peripheral wall 51 is configured by the outer side end walls 46, an extra mechanism is not placed in the first toner discharging port 49. Thus, if the toner cartridge 40 is attached to the developing case 62, the toner cartridge 40 and the developing case 62 can therefore be in close contact with each other. Accordingly, it is possible to prevent the toner from leaking between the toner cartridge 40 and the developing case 62.

Since the shutter 111 is swingably supported by the both side walls (the right and left side walls 69, 70) of the developing case 62, the toner introduction port 88 can be stably opened and closed. When a portion of supporting the shutter 111 is configured by the both side walls of the developing case 62, an extra mechanism is not placed in the toner introduction port 88. Thus, if the toner cartridge 40 is attached to the developing case 62, the toner cartridge 40 and the developing case 62 can therefore be in close contact with each other. Accordingly, it is possible to prevent the toner from leaking between the toner cartridge 40 and the developing case 62.

When the portion of supporting the shutter 111 is configured by the both side walls of the developing case 62, a space is formed in a portion of the developing case 62 which is in the middle between the both side walls. During the operations of attaching and detaching the toner cartridge 40 to and from the developing case 62, an access of the toner cartridge 40 into the developing case 62 can be easily performed.

When the inner peripheral wall 51 is not swung, the shutter 111 cannot be swung. Therefore, the toner introduction port 88 can be surely maintained in the closed state, and the toner can be prevented from leaking from the developing case 62.

When the toner cartridge 40 is not attached to the developing case 62 of the process cartridge 20, the first width-direction projections 145 and the second width-direction projections 150 of the toner cartridge 40 are not engaged with the opening/closing lever 113 disposed on the developing case 62 as shown in FIG. 11A. Therefore, the swinging of the inner peripheral wall 51 provided to the toner cartridge 40 is restricted, and it is possible to prevent the first toner discharging port 49 from being accidentally opened.

When the toner cartridge 40 is attached to the developing case 62, the first width-direction projections 145 and the second width-direction projections 150 are engaged with the opening/closing lever 113 as shown in FIGS. 11C and 11D. Therefore, in accordance with the operation of the opening/closing lever 113, the swinging of the inner peripheral wall 51 by the first width-direction projections 145 and the second width-direction projections 150, i.e., the opening/closing of the first toner discharging port 49, and the swinging of the shutter 111 by the second radial projection 57 and the third radial projection 63 interlocked with the first width-direction projections 145 and the second width-direction projections 150, i.e., the opening/closing of the toner introduction port 88 are enabled as shown in FIGS. 3 and 10.

Therefore, as shown in FIG. 3, if the first toner discharging port 49 and the toner introduction port 88 are opened in the state where the toner cartridge 40 is attached to the developing case 62, the first toner discharging port 49 and the toner introduction port 88 communicate with each other so that the toner can be supplied from the toner cartridge 40 to the developing case 62.

When, as shown in FIG. 10, the first toner discharging port 49 and the toner introduction port 88 are closed in the state where the toner cartridge 40 is attached to the developing case 62, the toner cartridge 40 can be detached from the developing case 62 without causing the toner to leak from the first toner discharging port 49 and the toner introduction port 88 as shown in FIG. 8.

In a state where the toner cartridge 40 is detached from the developing case 62, even when the opening/closing lever 113 is operated, the shutter 111 is not swung. Thus, the developing case 62 can be maintained to the state where the toner introduction port 88 is closed. As described above, in the toner cartridge 40, the inner peripheral wall 51 is not swung. Thus, the toner cartridge is maintained to the state where the first toner discharging port 49 is closed.

As a result, the toner can be prevented from leaking from the toner cartridge 40 and the process cartridge 20, by the simple configuration.

The above-described operations of opening and closing the first toner discharging port 49 and the toner introduction port 88 can be performed by the simple configuration in which the first width-direction projections 145, the second width-direction projections 150, the second radial projection 57 and the third radial projection 63 are disposed on the toner cartridge 40 as shown in FIG. 5.

When, as shown in FIG. 8, the toner cartridge 40 is detached from the developing case 62, the swinging of the shutter 111 is restricted. Therefore, the state where the toner introduction port 88 is closed can be surely maintained, and the toner can be prevented from leaking from the developing case 62.

MODIFICATIONS

In the above-described aspects, the process cartridge 20 integrally includes the photosensitive drum 28 and the developing roller 104, and the process cartridge 20 is detachably attached to the body casing 2. For example, the developing device may not include the photosensitive drum 28, another unit having the photosensitive drum 28 may be disposed, and the developing device may be detachably attached to the unit. The first width-direction projections 145 and the second width-direction projections 150 may be formed as an integral member.

What is claimed is:

1. A developing device comprising:

a developer carrier that carries developer;

a developing case that supports the developer carrier; and a toner cartridge that houses the developer and is attachable to and detachable from the developing case, wherein the toner cartridge comprises:

a toner case comprising a first opening for supplying the developer to the developing case; and a first blocking member that opens and closes the first opening, wherein the developing case comprises:

a second opening for receiving the developer supplied from the first opening;

a second blocking member that opens and closes the second opening; and an opening/closing member that is swingably disposed on the developing case and opens and closes the first blocking member and the second blocking member, wherein the opening/closing member is swingable among predetermined positions, the predetermined positions comprising:

a first position where the toner cartridge is detached from the developing case and the second opening is closed;

a second position where the toner cartridge is attached to the developing case and the first opening and the second opening are opened to communicate with each other; and a third position where the toner cartridge is attached to the developing case and the first opening and the second opening are closed to block communication between the first opening and the second opening, the third position being between the first position and the second position, and wherein the opening/closing member swings from the first position to the third position in accordance with attachment of the toner cartridge to the developing case.

2. The developing device according to claim 1, wherein the toner cartridge further comprises:

a first projecting portion that pushes the opening/closing member to swing the opening/closing member from the first position to the third position in accordance with attachment of the toner cartridge to the developing case.

3. The developing device according to claim 2, wherein the toner case comprises:

an outer case comprising the first opening; and an inner case that is housed swingably with respect to the outer case and houses the developer, the inner case comprising:

the first blocking member; and a third opening for supplying the developer to the first opening, and wherein the inner case comprises:

a second projecting portion that swings the first blocking member to open the first opening by being pushed by the opening/closing member in accordance with swinging of the opening/closing member from the third position to the second position.

4. The developing device according to claim 1, wherein the opening/closing member comprises a first gripping portion, wherein the toner cartridge comprises a second gripping portion, and wherein the first gripping portion is adjacent to the second gripping portion when the opening/closing member is at the second position.

5. The developing device according to claim 1, wherein operations of opening and closing the second opening by the second blocking member are executed through operations of opening and closing the first opening by the first blocking member.

6. The developing device according to claim 1, wherein the toner cartridge is attachable to and detachable from the developing case in a direction perpendicular to a longitudinal direction of the developer carrier, and wherein the first blocking member is swingably supported by side walls of the toner case in the longitudinal direction of the developer carrier.

7. The developing device according to claim 6, wherein the second blocking member is swingably supported by side walls of the developing case in the longitudinal direction of the developer carrier.

8. The developing device according to claim 7, wherein the opening/closing member swings the first blocking member to swing the second blocking member.

9. The developing device according to claim 8, wherein the toner cartridge further comprises:

a first projection that engages with the opening/closing member if the toner cartridge is attached to the developing case, the first projection swinging the first blocking member to open or close the first opening in accordance with the operation of the opening/closing member; and a second projection that swings the second blocking member to open or close the second opening in conjunction with an operation of the first projection.

10. The developing device according to claim 7, wherein the swinging of the second blocking member is restricted if the toner cartridge is detached from the developing case.

11. A developing device comprising:

a developer carrier that carries developer;

a developing case that supports the developer carrier; and a toner cartridge that houses the developer and is attachable to and detachable from the developing case, wherein the toner cartridge comprises:

a toner case comprising a first opening for supplying the developer to the developing case; and a first blocking member that opens and closes the first opening, wherein the developing case comprises:

a second opening for receiving the developer supplied from the first opening;

a second blocking member that opens and closes the second opening; and an opening/closing member that is swingably disposed on the developing case and opens and closes the first blocking member and the second blocking member, wherein the opening/closing member is swingable among predetermined positions, the predetermined positions comprising:

a first position where the toner cartridge is detached from the developing case and the second opening is closed;

a second position where the toner cartridge is attached to the developing case and the first opening and the second opening are opened to communicate with each other; and a third position where the toner cartridge is attached to the developing case and the first opening and the second opening are closed to block communication between the first opening and the second opening, the third position being between the first position and the second position, and wherein the opening/closing member moves the toner cartridge from an attaching position to the developing case in a detaching direction of the toner cartridge in accordance with swinging of the opening/closing member from the first position to the third position.

12. The developing device according to claim 11, wherein the toner cartridge further comprises:

a first projecting portion that moves the toner cartridge from the attaching position to the developing case in the detaching direction by being pushed by the opening/closing member in accordance with the swinging of the opening/closing member from the first position to the third position.

13. The developing device according to claim 12, wherein the toner case comprises:

an outer case comprising the first opening; and an inner case that is housed in the outer case and houses the developer, the inner case comprising:

the first blocking member; and a third opening for supplying the developer to the first opening, and wherein the inner case comprises the first projecting portion pushed by the opening/closing member that swings the first blocking member to close the first opening by being pushed by the opening/closing member in accordance with the swinging of the opening/closing member from the second position to the third position.

14. The developing device according to claim 13, wherein operations of opening and closing the second opening by the second blocking member are executed through operations of opening and closing the first opening by the first blocking member.

15. The developing device according to claim 13, wherein the toner cartridge is attachable to and detachable from the developing case in a direction perpendicular to a longitudinal direction of the developer carrier, and wherein the first blocking member is swingably supported by side walls of the toner case in the longitudinal direction of the developer carrier.

16. The developing device according to claim 15, wherein the second blocking member is swingably supported by side walls of the developing case in the longitudinal direction of the developer carrier.

17. The developing device according to claim 16, wherein the opening/closing member swings the first blocking member to swing the second blocking member.

18. The developing device according to claim 17, wherein the toner cartridge further comprises:

a first projection that engages with the opening/closing member if the toner cartridge is attached to the developing case, the first projection swinging the first blocking member to open or close the first opening in accordance with the operation of the opening/closing member; and a second projection that swings the second blocking member to open or close the second opening in conjunction with an operation of the first projection.

19. The developing device according to claim 16, wherein the swinging of the second blocking member is restricted if the toner cartridge is detached from the developing case.

* * * * *